US011078792B2

(12) United States Patent
Sun et al.

(10) Patent No.: US 11,078,792 B2
(45) Date of Patent: Aug. 3, 2021

(54) CONTROL SIGNALS FOR FREE-PISTON ENGINES

(71) Applicant: Regents of the University of Minnesota, Minneapolis, MN (US)

(72) Inventors: Zongxuan Sun, Minneapolis, MN (US); Chen Zhang, Minneapolis, MN (US); Keyan Liu, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 1101 days.

(21) Appl. No.: 15/607,937

(22) Filed: May 30, 2017

(65) Prior Publication Data

US 2017/0350248 A1 Dec. 7, 2017

Related U.S. Application Data

(60) Provisional application No. 62/346,221, filed on Jun. 6, 2016.

(51) Int. Cl.

| | |
|---|---|
| ***F01B 11/02*** | (2006.01) |
| ***F02B 71/04*** | (2006.01) |
| ***F02B 71/02*** | (2006.01) |
| ***F01B 11/08*** | (2006.01) |

(52) U.S. Cl.

CPC ..... *F01B 11/02* (2013.01); *F01B 11/08* (2013.01); *F02B 71/045* (2013.01); *F02B 71/02* (2013.01)

(58) Field of Classification Search

CPC ..... F01B 11/02; F01B 11/08; F02B 71/00; F02B 71/02; F02B 71/04; F02B 71/045; F02B 63/06; F02D 41/1497; F02D 35/023

(Continued)

(56) References Cited

U.S. PATENT DOCUMENTS 5,878,569 A * 3/1999 Satzler ..... F01B 11/00 60/418
6,983,724 B2 * 1/2006 Carlson ..... F02B 71/02 123/46 R (Continued)

OTHER PUBLICATIONS

Achten et al., "Horsepower with Brains: The Design of the Chiron Free Piston Engine," SAE Technical Paper Series, 2000-01-2545, 2000.

(Continued)

*Primary Examiner* — Phutthiwat Wongwian
*Assistant Examiner* — Arnold Castro
(74) *Attorney, Agent, or Firm* — Fish & Richardson P.C.

(57) ABSTRACT

The subject matter of this specification can be embodied in, among other things, a method for operating a hydraulic free piston engine includes receiving, at an engine controller for a hydraulic free piston engine, an energy parameter that is representative of an amount of fluid energy to be output by the engine, and a measured fluid pressure value of a fluid load of the engine, determining a piston trajectory of a piston within a hydraulic chamber of the engine, determining a fuel volume value and a servo valve actuation parameter, based on the energy parameter and the measured fluid pressure value, providing a fuel control signal to a fuel control device of the engine based on the fuel volume value, and providing, based on the servo valve actuation parameter and the piston trajectory, a servo valve control signal to a servo valve.

24 Claims, 9 Drawing Sheets

(58) Field of Classification Search
USPC ..... 123/18 R, 46 A
See application file for complete search history.

(56) References Cited

U.S. PATENT DOCUMENTS

| | | | | |
|---|---|---|---|---|
| 2001/0054351 | A1* | 12/2001 | Pratt | F15B 11/028 91/361 |
| 2005/0028520 | A1* | 2/2005 | Chertok | F02G 1/043 60/517 |
| 2005/0082994 | A1* | 4/2005 | Qiu | F16F 7/1011 318/128 |
| 2009/0031991 | A1* | 2/2009 | Lindgarde | H02P 25/06 123/46 R |
| 2011/0083643 | A1* | 4/2011 | Sturman | F01B 11/006 123/46 R |
| 2013/0025570 | A1* | 1/2013 | Sturman | F02B 71/045 123/46 R |
| 2013/0298874 | A1* | 11/2013 | Sun | F02B 71/04 123/46 A |
| 2016/0032820 | A1* | 2/2016 | Sun | F02B 71/00 123/46 E |
| 2019/0390623 | A1* | 12/2019 | Roelle | F02B 71/04 |

OTHER PUBLICATIONS

Backé, "The Present and Future of Fluid Power," Proceedings of the Institution of Mechanical Engineers, Part I: Journal of Systems and Control Engineering, 207(4):193-212, Nov. 1993.

Du, Can. "Variable Supply Pressure Electrohydraulic System for Efficient Multi-axis Motion Control" Diss. University of Bath, 2014.

Finzel, R. and Helduser, S. "Energy-efficient Electro-hydraulic Control Systems for Mobile Machinery / Flow Matching," in Proc. 6th Int. Fluid Power Conf. Dresden, Germany, 2008.

Li et al., "Active motion control of a hydraulic free piston engine," IEEE/ASME Transactions on Mechatronics, 19(4):1148-59, Aug. 2014.

Li et al., "Precise Piston Trajectory Control for a Free Piston Engine," Control Engineering Practice, 31;34:30-8, Jan. 2015.

Mikalsen et al., "A review of free-piston engine history and applications," Applied Thermal Engineering, 27(14-15):2339-52, Oct. 2007.

Schoenau et al., "Dynamic analysis of a variable displacement pump," Journal of Dynamic Systems, Measurement, and Control, 112(1):122-32, Mar. 1990.

Tomizuka et al., "Analysis and Synthesis of Discrete-time Repetitive Controllers," ASME Trans. J. Dyn. Syst., Meas. Control, 111(3):353-8, Sep. 1989.

Wang and Wang, "An Energy-saving Pressure-compensated Hydraulic System with Electrical Approach," IEEE/ASME Trans. Mechatronics, 19(2):570-8, Apr. 2014.

Wang, "Adaptive Robust Control of Variable Displacement Pumps," in 6th Fluid Power Net International Annual PhD Symposium, West Lafayette, IN, 2010.

* cited by examiner

CONTROL SIGNALS FOR FREE-PISTON ENGINES

CROSS REFERENCE TO RELATED APPLICATIONS

This application is a non-provisional of and claims priority to U.S. Provisional Patent Application No. 62/346,221, filed on Jun. 6, 2016, the entire contents of which are hereby incorporated by reference.

TECHNICAL FIELD

This document relates to systems and methods relating to the control of hydraulic free-piston engines.

BACKGROUND

Fluid power is widely used in industrial applications due to its high power density, low space requirement and simplicity in longitudinal force/motion generation. In addition, a significant portion of these applications are mobile, such as excavators and wheel loaders. Due to the volatile load requirement of these applications, the corresponding fluid power sources is required to provide the actuators different flow rate at any pressure in real time. Currently, such fluid power sources usually consist of an internal combustion engine (ICE) that drives a hydraulic pump. The ICE as well as the pump are sized for the maximum load and/or maximum fluid power (e.g., maximum pressure and flow rate). However, for a significant portion of a typical duty cycle, only partial load is utilized. Consequently, relief valves and throttling valves are employed to reduce the output flow rate and adjust the pressure as desired for the actuators. However, the system efficiency is compromised due to throttling loss.

Other technologies in fluid power field have been proposed to address the aforementioned challenges. For example, displacement-based control techniques aim to provide a desired flow rate at any given pressure by controlling the supply pump speed or displacement. The former is achieved via a fixed displacement pump driven by an electric motor and by controlling the motor operation frequency/speed in real time. Although such systems can have short response times, the nature of electric motors can make them inappropriate for mobile applications. The latter utilizes a variable displacement pump driven by an ICE and adjusts the flow rate by changing the pump's displacement in real time. In this case, both the pump and ICE can have long response times to load variations, which generates significant delay in the entire system.

SUMMARY

In general, this document describes systems and methods relating to the control of hydraulic free-piston engines (HPFE). In particular, this document describes systems and methods that allow for independent pressure and flow rate control of hydraulic free-piston engines. In particular, some embodiments of the systems and methods provided herein are designed or programmed to provide a control signal of a desired piston trajectory for the FPE that produces any required flow rate at any load pressure.

In a first aspect, a method for operating a hydraulic free piston engine includes receiving, at an engine controller for a hydraulic free piston engine, an energy parameter that is representative of an amount of energy to be output by the engine, and, determining, by the engine controller, a target fluid flow rate per stroke of a hydraulic chamber containing a piston based on the energy parameter and a measured load pressure, determining, by the engine controller, a piston trajectory of the piston within the hydraulic chamber based on (i) a dynamic trajectory model, (ii) the energy parameter, (iii) the measured load pressure, and (iv) the target fluid flow rate, determining, from the dynamic trajectory model, a fuel injection amount, determining, from the dynamic trajectory model, a target position of a servo valve, providing, by the engine controller, a fuel control signal based on the fuel injection amount to a fuel control device, and providing, by the engine controller and based on the piston trajectory, a servo valve control signal to a servo valve in fluid communication with the fluid load, wherein the servo valve operates in a help mode and a resist mode.

Various implementations can include some, all, or none of the following features. The 'determined desired piston trajectory' can include computing, from the dynamic trajectory model, a desired switching time of the servo valve based on the dynamic trajectory model. Controlling operation of the servo valve can include changing the position of the servo valve from a first configuration to a second configuration, or changing from the second configuration to the first configuration. The position of the servo valve can determine whether the servo valve operates in one of two function modes, wherein the two function modes include a resist mode and a help mode. The 'determined desired piston trajectory' can include computing, from the dynamic trajectory model, a hydraulic force. The hydraulic force value can be computed based on the desired load pressure, a cross-section area of a hydraulic chamber, and the position of the servo valve. A magnitude of the control signal can determine whether to change the position of the servo valve. The reference trajectory signal can include a data set including a plurality of piston location points and corresponding time values. The data set can describe the desired piston trajectory at a start point, an end point, and a collection of intermediate points between the start and end points. The collection of intermediate points between the start and end points can form a non-linear relationship as a function of time. The collection of intermediate points between the start and end points describes how the piston moves within the at least one hydraulic chamber between the start and end points. The collection of intermediate points can be representative of how the piston moves when the piston located in an intermediate location within the hydraulic chamber that is independent of how the piston moves at the start and end points. The desired piston trajectory can include a position of the piston within the at least one hydraulic chamber as a function of time. The hydraulic free piston engine can include multiple hydraulic chambers, and wherein the position of the servo valve can determine which hydraulic chambers are connected to a high pressure source and which hydraulic chambers are connected to a low pressure source. Outputting the reference trajectory signal to control operation of the servo valve can include adjusting a current piston trajectory to the determined desired piston trajectory. The method can be executed with every stroke cycle of the piston within the at least one hydraulic chamber. The method can also include a check function, the check function including determining, by the engine controller, a maximal load pressure and a maximal fluid flow rate of the engine, and comparing the current load pressure and fluid flow rate to the maximal load pressure and the maximal fluid flow rate, wherein, if the current load pressure and fluid flow rate are greater than the maximal load pressure and the maximal fluid flow rate, the energy parameter is reselected. The energy parameter can include a compression ratio value for the at least one hydraulic chamber. Receiving the energy parameter can include receiving the compression ratio value from a list of acceptable compression ratio values. The required fuel amount can be a fuel mass.

In a second aspect, a hydraulic free piston engine system includes at least one engine combustion chamber, a piston movably disposed within at least one hydraulic chamber, the piston being operatively connected with a load device and the piston operatively connected to the at least one engine combustion chamber, and a servo valve for connecting or disconnecting the piston to the load device, and an engine controller in communication with the servo valve; the engine controller being programmed to receive a compression ratio of the engine, receive the desired load pressure and fluid flow rate per stroke of the piston within the at least one hydraulic chamber, determine a desired piston trajectory of the piston within the at least one hydraulic chamber to achieve based on inputting into a dynamic trajectory model the energy parameter, and the desired load pressure, and a target fluid flow rate, and computing, from the dynamic trajectory model, a fuel injection amount, and determine, from the dynamic trajectory model, a target position of a servo valve, and provide a reference trajectory signal to control operation of a servo valve and a fuel injector to move the piston within the at least one hydraulic chamber at the determined desired piston trajectory.

In a third aspect, a method for operating a hydraulic free piston engine includes receiving, at an engine controller for a hydraulic free piston engine, an energy parameter that is representative of an amount of fluid energy to be output by the engine, and a measured fluid pressure value of a fluid load of the engine, determining, by the engine controller, a piston trajectory of a piston within a hydraulic chamber of the engine, determining, by the engine controller, a fuel volume value and a servo valve actuation parameter, based on the energy parameter and the measured fluid pressure value, providing, by the engine controller, a fuel control signal to a fuel control device of the engine based on the fuel volume value, and providing, by the engine controller and based on the servo valve actuation parameter and the piston trajectory, a servo valve control signal to a servo valve in fluid communication with the hydraulic chamber and the fluid load, wherein the servo valve is responsive to the servo valve control signal to switch between a help mode configuration and a resist mode configuration.

Various implementations can include some, all, or none of the following features. Determining, by the engine controller, a fuel volume value and a servo valve actuation parameter, based on the energy parameter and the measured fluid pressure value can include balancing the fuel volume value and the servo valve actuation value such that the engine provides the amount of fluid energy. Determining, by the engine controller, a fuel volume value and a servo valve actuation parameter, based on the energy parameter and the measured fluid pressure value can include determining the fuel volume value based on the measured pressure and the energy parameter, and determining the servo valve actuation parameter based on the measured fluid pressure and a load energy parameter that is less than or equal to the energy parameter and is representative of an amount of fluid energy to be provided to the fluid load.

The systems and techniques described here may provide one or more of the following advantages. First, a system can provide real time control of desired flow rate at any given load pressure and therefore eliminate or significantly reduce the throttling loss. Second, the modular nature of the hydraulic free piston engine makes it possible to decouple different drive and working circuits to enable independent pressure and flow rate control for those circuits. Third, the time constant of the proposed system and method is comparable with the time constant of the hydraulic valve and therefore it can ensure the performance of the actuation.

The details of one or more implementations are set forth in the accompanying drawings and the description below. Other features and advantages will be apparent from the description and drawings, and from the claims.

DETAILED DESCRIPTION

As an alternative to an internal combustion engine (ICE), a free-piston engine (FPE) eliminates the mechanical crankshaft used in an ICE and removes the associated constraints on piston motion. Due to this extra degree of freedom and reduced inertia, the FPE is able to generate variable output power with higher efficiency and fewer emissions, while also providing a short response time.

A hydraulic free piston engine combines a free piston engine (FPE) with a linear hydraulic pump to form a hydraulic free piston engine (HFPE). In various embodiments, HFPEs can be used as a fluid power source, especially for mobile applications such as a vehicle. In general, this document describes example working principles of an example HFPE as a fluid power source and an example HFPE model provided herein can be applied to a system or applied as a method for generating a control signal for the HFPE. Control techniques described below can regulate an output flow rate of the HFPE at any appropriate load pressure and to realize throttle-less fluid power control.

Effectiveness of these techniques can be demonstrated through analytical simulation, where results show that these techniques can provide different output flow rates for a given load pressure, thus demonstrating the capability of the HFPE as an efficient and flexible mobile fluid power source.

An exemplary hydraulic free piston engine (HFPE) is an alternative engine architecture that combines the ICE and the linear hydraulic pump into one device. HFPEs have low inertial, high modularity, high structural simplicity and short response time (e.g., on the order of tens of milliseconds). All these advantages offer the HFPE a good potential as a throttle-less mobile fluid power source. As will be described in more detail below, the piston motion control of an HFPE may be achieved through the use of a virtual crankshaft.

Figure 1:
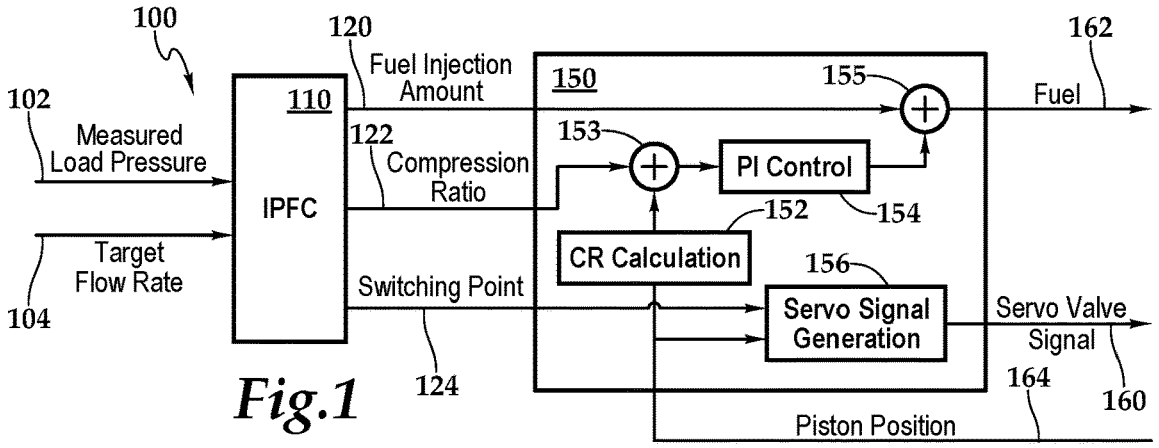
FIG. 1 is a block diagram of an example hydraulic free piston engine (HPFE) controller.

FIG. 1 is a block diagram of an example hydraulic free piston engine (HPFE) controller 100. The controller 100 includes an independent pressure and flow control (IPFC) module 110 and a FPE controller 150. The IPFC module 110 generates a feed forward fuel injection signal 120 representative of a volume of fuel to be provided in a combustion cycle of an ICE, a compression ratio value 122 representative of the compression ratio of the ICE during the combustion cycle, and a servo valve switching point value 124. The servo valve switching point value 124 is representative of a time and/or location of a hydraulic piston in a hydraulic chamber during a pumping stroke, at which a servo valve is to be actuated from a "help" mode to a "resist" mode, and vice versa. In general, by controllably switching the servo valve in coordination with the piston stroke, a variable amount of fluid can be flowed from the chamber to a fluid load for a given HFPE running speed. The controller 100 updates the values 120, 122, and/or 124 for each stroke according to a measured load pressure value 102 and target flow rate value 104.

A FPE controller 150 generates a servo valve signal 160 and a fuel volume amount signal 162 based on the fuel injection signal 120, the compression ratio value 122, the servo valve switching point value 124, and an FPE piston position feedback signal 164. The FPE controller 150 applies the piston position feedback signal 164 to a compression ratio calculation module 152, and sums the resulting signal with the compression ratio value 152 at a summation node 153. The summed value is applied to a proportional-integral control module 154, and the resulting signal is summed with the fuel injection signal 120 at a summation node 155 to determine the fuel volume amount signal 162. A servo signal generation module 156 applies the servo valve switching point value 124 and the FPE piston position feedback signal 164 to determine the servo valve signal 160.

The fuel volume amount signal 162 is provided to a fuel volume control device (not shown) such as a fuel injector or a carburetor to control a flow of fuel for use in the combustion cycle of the HFPE. As such, the fuel volume amount signal 162 can control the speed of the HFPE and the amount of fluid energy available for delivery to a fluid load. The servo valve signal 160 is provided to a servo valve (not shown) that can be switched between a first mode in which a hydraulic chamber is in fluid communication with the fluid load, and a second mode in which the hydraulic chamber is in not in fluid communication with the fluid load (e.g., bypassing the fluid load). In general, the servo valve signal 160 causes the servo valve to switch between these two modes at a selectable point in the pumping stroke of the piston. For example, the servo valve signal 160 can be timed to cause the servo valve to switch fluid flow from the load to the bypass when the piston has completed of its total stroke, and as such cause or 75% of the volume of that stroke to be provided to the load. The position of the piston is provided at the piston position feedback signal 164, and the pressure of the fluid load is fed back to the IPFC module 110 as the measured load pressure value 102.

As such, the servo valve signal 160 and the fuel volume amount signal 162 can be varied and balanced to achieve various different fluid power outputs at different HPFE operating speeds and load pressures. Examples of HPFEs, hydraulic cylinders, and servo valves will be described further throughout the remainder of this document.

The controller 100 can be used to provide at least either of two control techniques for achieving HFPE's potential as a throttle-less fluid power source. One of these techniques can be referred to as frequency-based control, which can vary the compression ratio (CR) as well as the operation frequency of the HFPE according to a desired output flow rate and pressure by adjusting the fuel injection amount in each combustion cycle. The other of these techniques can be referred to as displacement-based control, which can enable automatic control of the output flow rate at any appropriate given pressure by changing the displacement in each stroke of the HFPE through the virtual crankshaft mechanism.

FIGS. 2A-2D are schematic illustrations of an example opposed-piston opposed-cylinder (OPOC) hydraulic free-piston engine (HFPE) 200 at various points in an operational cycle. The HFPE is an opposed-piston opposed-cylinder (OPOC), two-stroke engine that combines high power density, compactness and self-balanced design.

The HPFE includes a combustion chamber 201*a* at one end, and a combustion chamber 201*b* at the opposite end. The combustion chamber 201*a* is defined by an outer piston 202*a*, an inner piston 203*a*, and a combustion cylinder 204*a*. The combustion chamber 201*b* is defined by an outer piston 202*b*, an inner piston 203*b*, and a combustion cylinder 204*b*. The outer pistons 202*a*, 202*b* are connected by a piston rod 210*a* and a piston rod 210*b*. The inner pistons 203*a*, 203*b* are connected by a piston rod 201*c*.

The HFPE 200 includes a hydraulic (or fluid) piston assembly 220. The hydraulic piston assembly 220 defines three hydraulic (or fluid) cylinders 222*a*-222*c*. The piston rod 210*a* passes though the hydraulic cylinder 222*a*, and includes a hydraulic piston 224*a*. The hydraulic piston 224*a* divides the hydraulic cylinder 222*a* into two portions, defining a hydraulic chamber 1 and a hydraulic chamber 4. The piston rod 210*b* passes though the hydraulic cylinder 222*c*, and includes a hydraulic piston 224*b*. The hydraulic piston 224*b* divides the hydraulic cylinder 222*c* into two portions, defining a hydraulic chamber 3 and a hydraulic chamber 6. The piston rod 210*c* passes though the hydraulic cylinder 222*b*, and includes a hydraulic piston 224*b*. The hydraulic piston 224*b* divides the hydraulic cylinder 222*b* into two portions, defining a hydraulic chamber 2 and a hydraulic chamber 5.

In the HFPE 200, combustions occur alternatively in the two combustion chambers 201*a* and 201*b* at each end. The collection of hydraulic chambers 1-6 connect either a high pressure source (HP) 230 (which may also be referred to a load device) or a low pressure source (LP) 232. The hydraulic chambers 4, 5 and 6 are interconnected to synchronize the motion of the inner piston 210*c* and the outer pistons 210*a*, 210*b*. The hydraulic pistons 224*a*-224*c*, and the outer pistons 202*a*-202*b* and the inner pistons 203*a*-203*b* are mounted as two moving pieces. Furthermore, due to the symmetric structure, the top dead center (TDC) instant of a combustion chamber always indicates the bottom dead center (BDC) instant of the other chamber simultaneously.

Figure 2A:
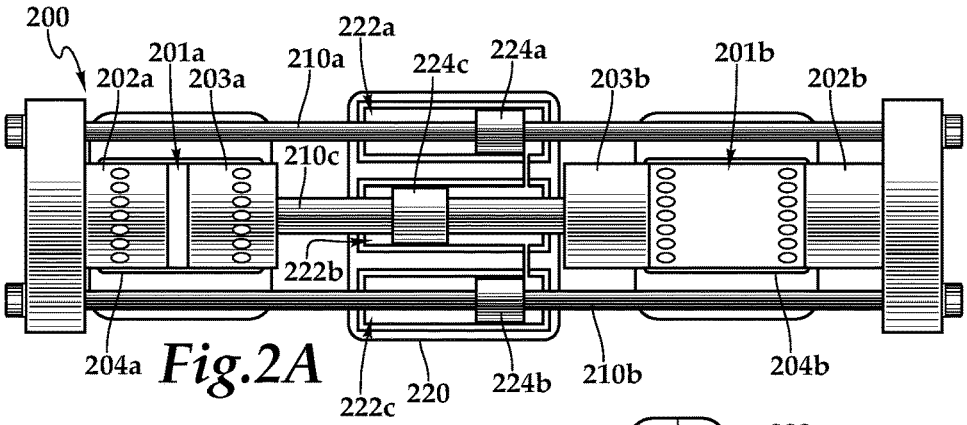
FIGS. 2A-2D are schematic illustrations of an example opposed-piston opposed-cylinder (OPOC) hydraulic free-piston engine (HFPE) at various points in an operational cycle.
Figure 2B:
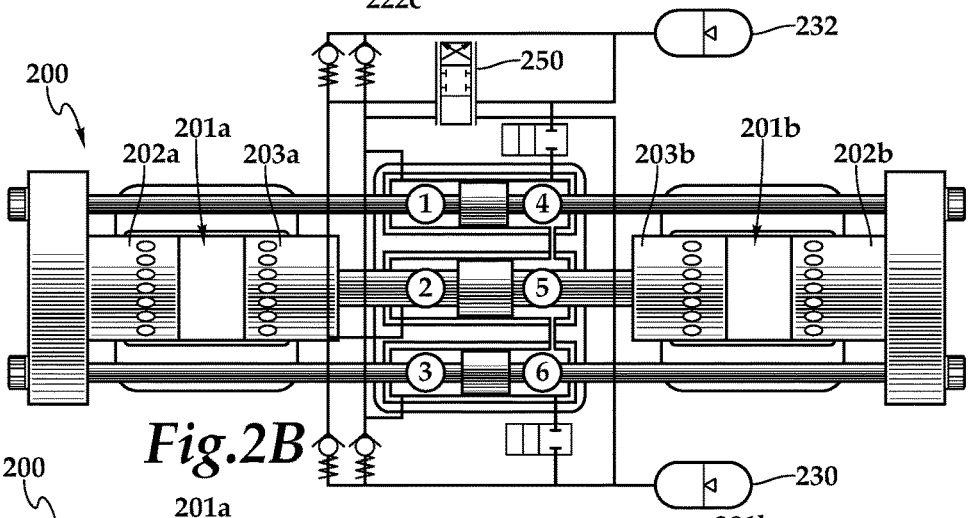
Figure 2C:
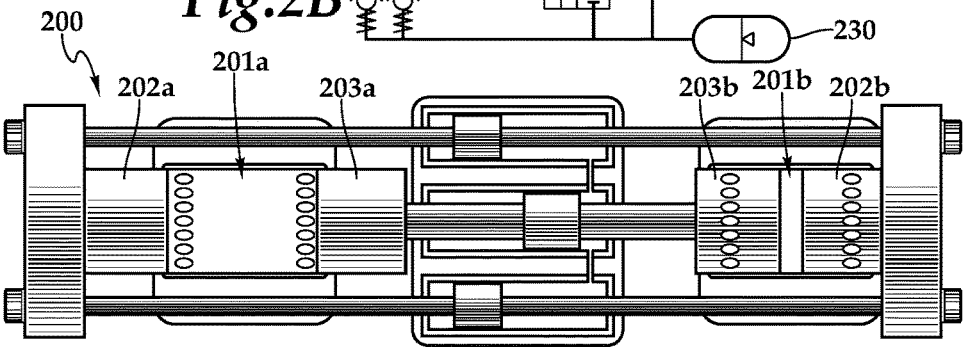
Figure 2D:
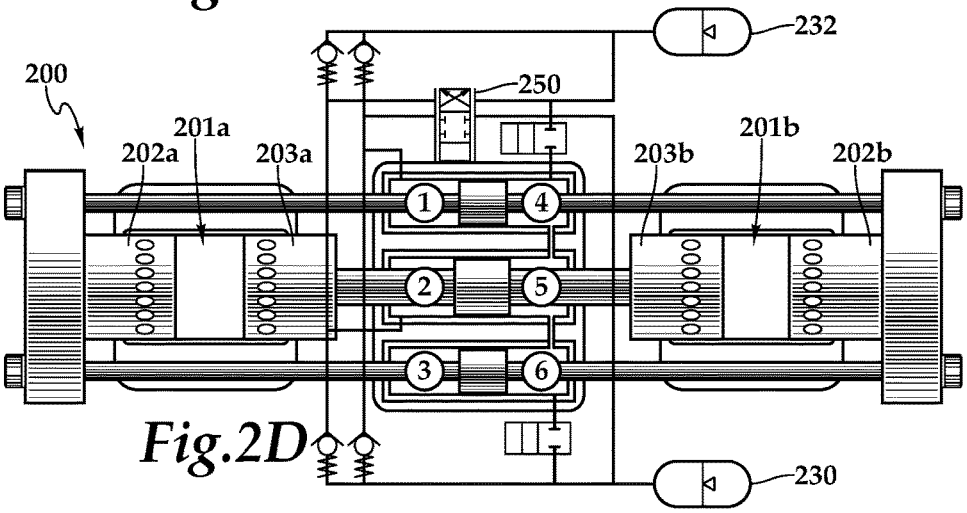

The operation principle of the depicted HFPE can be described as bellow. When the combustion chamber 201*a* fires at its TDC (FIG. 2A), the combustion force pushes the outer piston 202*a* and the inner piston 203*a* away from each other, forcing hydraulic chambers 1 and 3 to pump hydraulic oil (or other appropriate fluid) into the HP 230 and hydraulic chamber 2 to suck oil from LP 232 (FIG. 2B). Meanwhile, the combustion chamber 201*b* compresses its in-cylinder gases till its own TDC. Afterwards, the combustion chamber 201*b* fires (FIG. 2C) and hydraulic chamber 2 pumps fluid out to HP 230 while hydraulic chambers 1 and 3 draw fluid in from LP 232 (FIG. 2D). In the meantime, the combustion chamber 201*a* undergoes the compression process. In this manner, the HFPE 200 can provide fluid flow at each stroke.

Due to the absence of mechanical crankshaft, the motion of the piston pairs is governed by the combination of combustion force and hydraulic force. To control the piston motion and track a prescribed trajectory, a servo valve 250 is added to adjust the pressure in the hydraulic chambers 1-6 through its opening. More details about the HFPE operation principle and the virtual crankshaft mechanism can be found in [8], which has been incorporated by reference in its entirety.

Figure 3:
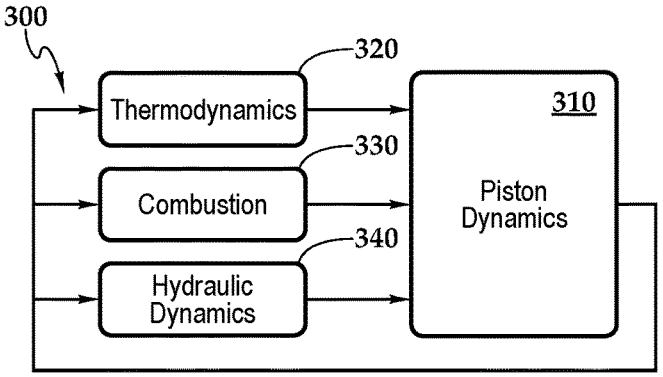
FIG. 3 shows a conceptual model of an example HFPE control system.

FIG. 3 shows a conceptual model of an example HFPE control system 300. A physics based model can be used in the systems and methods discussed herein. The basic model scheme is shown in FIG. 3. In some cases, an entire dynamic system can be generally divided into four parts, namely a collection of piston dynamics 310, thermodynamics 320, combustion 330, and hydraulic dynamics 340.

1. Thermodynamics

The dynamic of the in-cylinder gas pressure is governed by the first law of thermodynamics and the ideal gas law, as shown in Equations (1) through (3). Note Equation (2) is acquired by applying definitions of U, W and rearranging Equation (1).

$$\dot{U} = \dot{Q} - \dot{W} + \Sigma \dot{m}_i h_i - \Sigma \dot{m}_e h_e \tag{1}$$

$$\dot{P} = \frac{\gamma - 1}{V}\left[\dot{Q} - \frac{\gamma}{\gamma - 1}P\dot{V} + \frac{R\gamma}{\gamma - 1}T_i\dot{m}_i - \frac{R\gamma}{\gamma - 1}T\dot{m}_e\right] \tag{2}$$

$$PV = mRT \tag{3}$$

In the equations, U stands for the internal energy, Q stands for the heat transferred to the gas, and W is the expansion work. $m_i$, $h_i$, $m_e$, and $h_e$ represent intake mass flow and exhaust gas flow as well as their corresponding enthalpy. These four parameters are calculated through the gas exchange model, which was developed based on the new Benson's model, as shown in [8]. $\gamma$ is the specific heat rate, T is the temperature in Kalvin. P, V and m are the pressure, volume and mass of the gas in the combustion chamber, respectively. $T_i$ denotes the intake air temperature. R stands for the gas constant of air.

2. Combustion

The combustion can be modeled as an instantaneous heat release process upon detecting the combustion signal, and lasts for only one sample time in the simulation. The heat release rate can be calculated using (4), where $Q_{LHV}$ and $m_{fuel}$ stand for the lower heating value and mass of the fuel, respectively. t, $t_{sample}$ and $t_{comb}$ are the current time, sampling period and the time instant of the detecting combustion signal.

3. Hydraulic Dynamics

As mentioned in the previous section, the hydraulic chambers at the left side, namely the example chambers 1, 2 and 3 of FIG. 2, are connected to the high pressure 230 or low pressure 232 sources, whereas the three chambers 4, 5, and 6 on the right side are connected to each other as the synchronization mechanism. Hence, the rate of hydraulic pressure in the left chambers 1-3 can be represented as:

$$\dot{P}_{left} = \frac{\beta}{V_{left}}(Q_{servo} + Q_{piston}) \tag{5}$$

where $\dot{P}_{left}$ is the pressure rate of each left chamber, $\beta$ is the bulk modulus of the fluid, $V_{left}$ is the volume of the hydraulic chamber. $Q_{servo}$ represent the flow through the servo valve and $Q_{piston}$ is the flow caused by the piston motion:

$$Q_{servo} = C_d A_{ori}\sqrt{\frac{2(P_{left} - P_{source})}{\rho_{fluid}}} \tag{6}$$

$$Q_{piston} = A_h \dot{x} \tag{7}$$

where $C_d$ is the discharge coefficient of the servo valve and the $A_{ori}$ is the corresponding orifice area. $A_h$ is the area of the piston in the hydraulic chambers. $P_{source}$ is the hydraulic pressure of the connected hydraulic source via the servo valve. $\rho_{fluid}$ is the utilized fluid density. In some cases, the value of the $P_{source}$ can be varied between the high pressure sources and low pressure sources, according to which hydraulic source is connected via the servo valve. Both of these hydraulic sources may be simplified into ideal pressure sources, with all the dynamics ignored, in some cases.

Similarly, the pressure rate in the right chambers as well as the flow rate through the check valve can be achieved in the same way. The detailed information can be found in [8].

The dynamics of the servo valve can be considered as a second order system with a settling time of $\tau_s$ and a percentage overshot of $\Delta h$, as shown in (8). In the equation, $V_{signal}$ and $V_{max}$ are the input and maximum signal amplitude, respectively. K and $K_{max}$ denotes the effective and maximum orifice area, respectively.

$$\frac{K(s)}{V_{signal}(s)} = \frac{K_{max}}{V_{max}} \cdot \frac{\omega_n^2}{s^2 + 2\xi\omega_n + \omega_n^2} \tag{8}$$

where $$K = C_d \cdot A_{ori},\ \xi = \sqrt{\frac{\left(\ln\frac{\Delta h}{100}\right)^2}{\pi^2 + \left(\ln\frac{\Delta h}{100}\right)^2}}$$

and $$\omega_n = \frac{3.9}{\xi\tau_s}.$$

4. Piston Dynamics

Figure 4A:
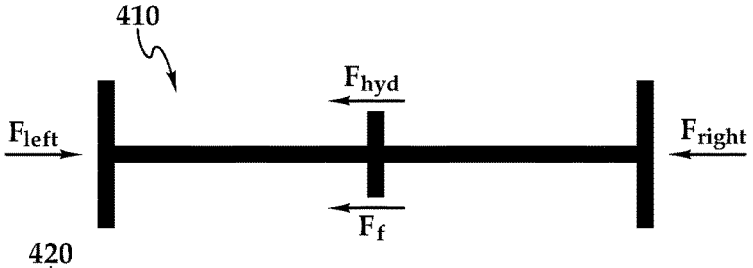
FIG. 4A is a free body diagram of an inner piston pair of an example HFPE.
Figure 4B:
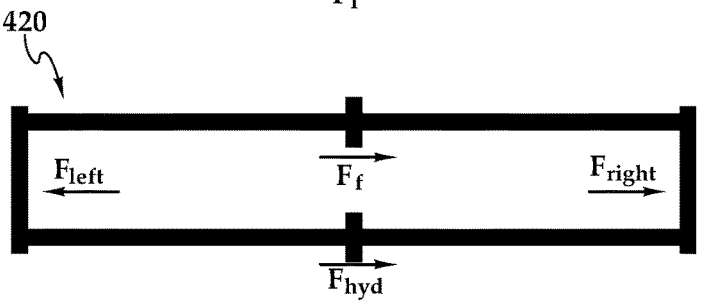
FIG. 4B is a free body diagram of an outer piston pair of an example HFPE.

Piston dynamics of the HFPE may be set as a function of the combustion chamber pressure, hydraulic chamber pressure and the friction. The free body diagram of the piston pairs is shown in FIGS. 4A-4B. FIG. 4A is a free body diagram 410 of an inner piston pair of an example HFPE such as the HFPE 200. FIG. 4B is a free body diagram 420 of an outer piston pair of the example HFPE 200.

The piston motion is governed by the Newton second law, as shown in Equation (9).

$$\ddot{x} = \frac{1}{M}(F_{left}(x, \dot{x}) - F_{right}(x, \dot{x}) - F_f(\dot{x}) + F_{hyd}(\dot{x})) = \frac{1}{M}(F_{net}(x, \dot{x}) - F_f(\dot{x}) + F_{hyd}(\dot{x})) \quad (9)$$

where $F_{left}$, $F_{right}$ and $F_{net}$ are the left, right and net in-cylinder gas's force, respectively. $F_{hyd}$ is the net hydraulic force. These four forces can be determined (e.g., calculated) in the aforementioned parts. $F_f$ is the friction force. In some cases, the friction force can be assumed to be a combination of Coulomb and viscosity friction. M stands for the mass of the piston.

To leverage the advantages of the HFPE 200 and achieve desired flow rate at different load pressure, two control methods may be applied to generating a control signal, namely a frequency-based control method and a displacement-based control method that will be explained in greater detail herein.

Frequency-Based Control

As mentioned above, the HFPE 200 is a device that combines an ICE and a linear hydraulic pump. The basic idea of the frequency based control is to regulate the operation frequency of the HFPE 200 and thus achieving the desired flow rate at any given pressure.

Figure 5:
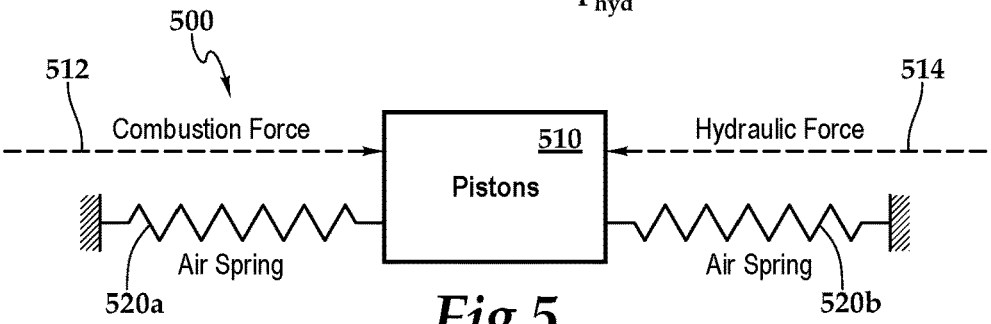
FIG. 5 shows a conceptual model of an example HFPE as a spring-mass system.

In order to better explain the principle of this control method, a simplified analogy is employed herein. FIG. 5 shows a conceptual model 500 of an example HFPE as a spring-mass system. In some cases, both a combustion force 512 and a hydraulic force 514 acting upon the pistons 510 can be neglected, so the HFPE 200 can be analogized as a second-order system consisting of pistons 510 and two air springs 520*a* and 520*b*. In addition, the entire system can be assumed to oscillate at its own natural frequency while operating. Since the in-cylinder gas force is determined by the idea gas law, the air springs 520*a* and 520*b* possess a highly nonlinear stiffness k which is a function of the oscillation amplitude, namely the stroke of the HFPE, Lst, i.e., k=g(Lst).

The stroke $L_{st}$ can further be derived as a monotonic function of the CR and therefore the HFPE's natural frequency f can be achieved as (10), which is also a function of the CR.

$$f = \frac{1}{2\pi}\sqrt{\frac{k}{M}} = \frac{1}{2\pi}\sqrt{\frac{g(L_{st})}{M}} = \Theta(L_{st}) = \Phi(CR) \quad (10)$$

The output flow rate of the HFPE 200 can be obtained via the stroke length $L_{st}$, hydraulic piston area $A_h$ and operation frequency f, as shown in (11).

$$Q = A_h \cdot L_{st} \cdot f = A_h \cdot L_{st}(CR) \cdot \Phi(CR) = \Psi(CR) \quad (11)$$

The combustion force 512 and the hydraulic force 514 may be taken into account. In some cases, the entire system may still oscillate at the natural frequency and original CR if the effects of these additional two forces 512, 514 counteract each other. From the energy perspective, it can be expressed that the total combustion energy is converted into the hydraulic energy completely. Therefore, for any given load pressure, there should be an appropriate fuel injection amount providing the right amount of combustion energy to cancel out the effect of the hydraulic force 514, thus sustaining the system to operate at a desired frequency and CR and to generate required output flow rate. In some cases, this fuel injection amount can be achieved via PID control, with a target CR.

Figure 6:
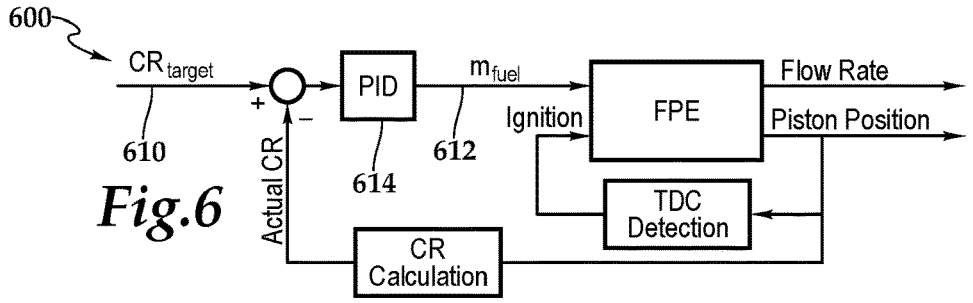
FIG. 6 is a block diagram of an example frequency-based HFPE control system.

FIG. 6 is a block diagram of an example frequency-based HFPE control system 600. Based on the discussion above, in some cases, the process of the frequency-based control method can include, for any appropriate desired flow rate, determining the corresponding natural frequency f and CR of the HFPE and set this CR as a target CR 610. With this target CR 610, the process of the frequency-based control method can include regulating a fuel injection amount 612 through a PID controller 614 to achieve a steady working condition of the HFPE at the required load pressure. In reality, there may exist some energy losses in the system, such as friction. As such, in some cases, these losses can be automatically coped by the PID controller 614.

Displacement Based Control

Figure 7:
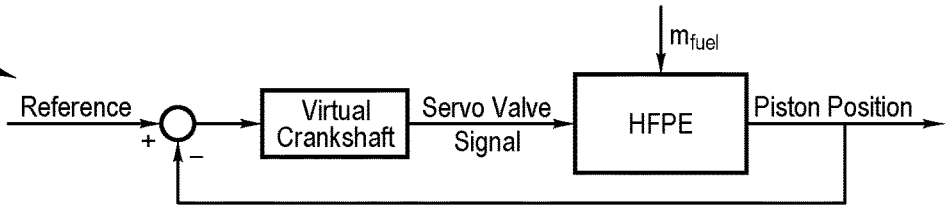
FIG. 7 is a block diagram of an example displacement-based HFPE control system.
Figure 8A:
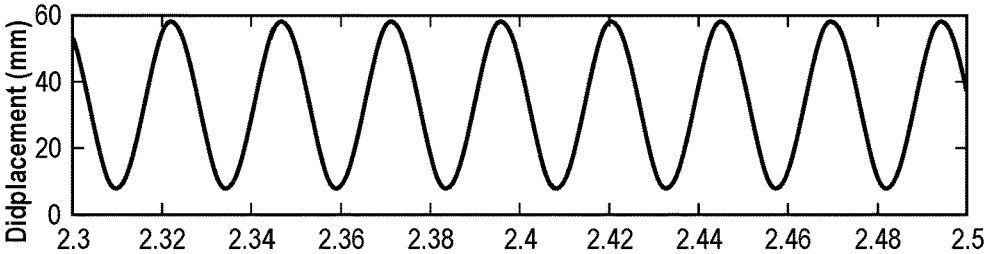
FIGS. 8A-8D are simulation test results showing an example of operational performance of an example HFPE under frequency-based control.
Figure 8B:
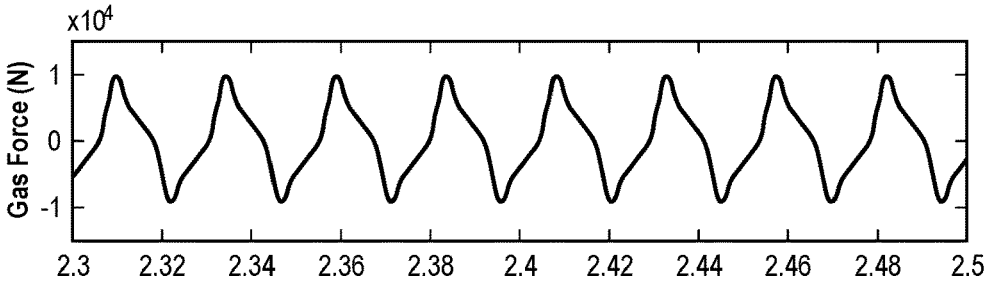
Figure 8C:
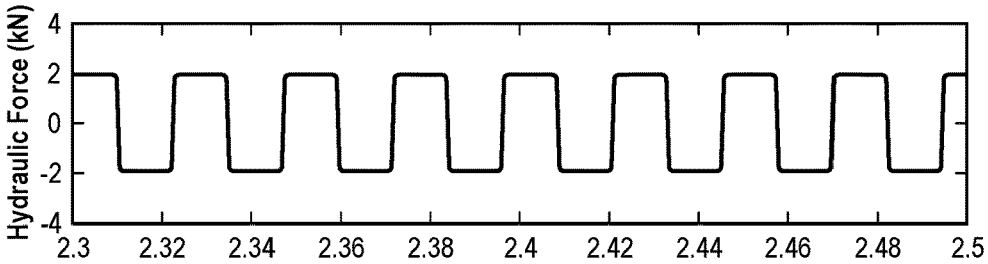
Figure 8D:
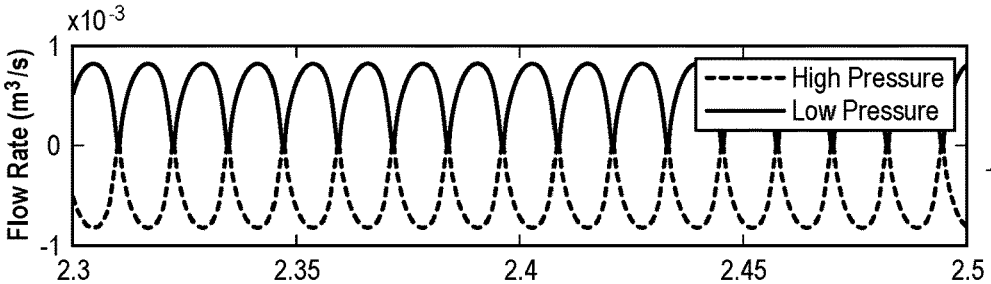

FIG. 7 is a block diagram of an example displacement-based HFPE control system 700. Unlike the frequency based control system 600, the displacement based control system 700 enables the HFPE 200 to work at a fixed operation frequency as well as CR, while still being able to produce variable output flow rate at any appropriate given load pressure. This may be achieved by varying the pump displacement (volume of fluid pumped out per stroke) within an engine stroke via the virtual crankshaft.

As described in [8], the virtual crankshaft mechanism is developed based on the principle of robust repetitive control [11], and enables precise piston motion control in the HFPE 200 through utilizing the servo valve 250. As can be seen in FIGS. 2B and 2D, the servo valve 250 is a three position, four way valve. In a first configuration, as shown in FIG. 2B, the servo valve connects the hydraulic chambers 1 and 3 to the HP source 230 and the hydraulic chamber 2 to the LP source 232 simultaneously, while the connection is completely opposite if the servo valve 250 is in its second configuration as shown in FIG. 2D. By varying the working position and the opening area of the servo valve 250, the virtual crankshaft mechanism performs the active regulation of the net hydraulic force acting on the piston pair 202*a* and 203*a* and the piston pair 202*b* and 203*b*, thus enabling the HFPE's pistons to track any prescribed trajectory reference.

Furthermore, due to the fact that the servo valve 250 can vary the connection among the three hydraulic chambers (e.g., the hydraulic chambers 1, 2 and 3 in FIGS. 2A-2D) and two hydraulic sources (e.g., the HP source 230 and the LP source 232) in real time, the equivalent displacement of the HFPE 200 within an engine stroke can also be adjusted even though the stroke length is fixed mechanically, as can be seen from the following example.

Assume that the engine is in a stroke where the left combustion chamber 201*a* is expanding. Referring to FIG. 2B, the piston pairs' motion in this stroke is pumping out the hydraulic oil in hydraulic chambers 1 and 3 to one of the hydraulic sources, and drawing in oil into hydraulic chamber 2 from the other source. If the servo valve 250 is at the first configuration during this process, the hydraulic chambers 1 and 3 are connected to the HP source 230 and the HFPE 200 generates positive flow rate. In contrast, if the servo valve 250 is at the second configuration, the hydraulic oil in both chamber 1 and 3 is dumped into the LP source 232 while the oil in the HP source 230 is sucked into the chamber 2, thus producing a negative output flow. As a result, the equivalent displacement of the HFPE 200 within the stroke may be achieved by calculating the net flow volume to the HP source 230 during the meantime. In some implementations, the HFPE 200 can operate as a digital hydraulic pump.

For any appropriate fuel injection amount within a certain range, the virtual crankshaft may generate the corresponding servo valve signal automatically to track the prescribed trajectory, and consequentially to produce corresponding flow rate. This means that the output flow rate can be varied by changing the fuel injection amount. More specifically, a large fuel injection amount can provide stronger combustion force and more combustion energy, which requires the virtual crankshaft to connect the output hydraulic chamber(s) to the HP source 230 for a longer period, thus generating larger output flow. Conversely, a small fuel injection may produce insufficient combustion energy to sustain the prescribed reference. In both cases, the virtual crankshaft can automatically offer more assistance for piston motion tracking by connecting the input chamber(s) to the HP source 230 for a longer time, which inevitably reduces the output flow. As a result, the output flow rate of the HFPE 200 in each stroke can possess a unique correlation with the fuel injection amount along a specific trajectory reference.

FIG. 7 shows a schematic illustration of a block diagram of an exemplary system 700 including displacement-based control. Based the aforementioned discussion, displacement-based control can include applying the virtual crankshaft and regulating the HFPE to track a prescribed reference. Displacement-based control can also include adjusting the fuel injection amount to match any given HP pressure. The virtual crankshaft can automatically change the servo valve signal and thus vary the output flow rate accordingly.

The equivalent pump displacement $D_{act}$ and relative equivalent displacement (RED) can be defined to represent the working status of the HFPE as a digital pump, as shown in (12) and (13).

$$D_{act} = \frac{Q}{f_{ref}} = \frac{h(m_{fuel})}{f_{ref}} \tag{12}$$

$$RED = \frac{D_{act}}{A_h(x_{BDC} - x_{TDC})} = \frac{h(m_{fuel})}{A_h f_{ref}(x_{BDC} - x_{TDC})} \tag{13}$$

where $D_{act}$ is the equivalent pump displacement. Q is the flow rate per stroke as a function of the fuel injection amount, $m_{fuel}$, i.e. $Q=h(m_{fuel})$. $F_{ref}$ is the frequency of the prescribed reference. $x_{TDC}$ and $x_{BDC}$ stand for the piston position at the TDC point and the BDC point, respectively.

Simulation Results

Frequency Based Control

An example stable operation performance of the HFPE 200 under the frequency based control is shown in FIGS. 8A-8D. In this example working condition, the target CR was set as 7 and the output hydraulic pressures was settled at 150 bar. The required fuel injection mass, derived through the PID control as shown in FIG. 6, was 16.17 mg. As illustrated by FIG. 8, the HFPE possesses a stable operation under this fuel injection amount, while delivering 34.03 L/min flow rate.

It is also expected that, at fixed hydraulic pressures, the HFPE 200 is able to vary the flow rate independently by adjusting the fuel injection quantities.

Figure 9A:
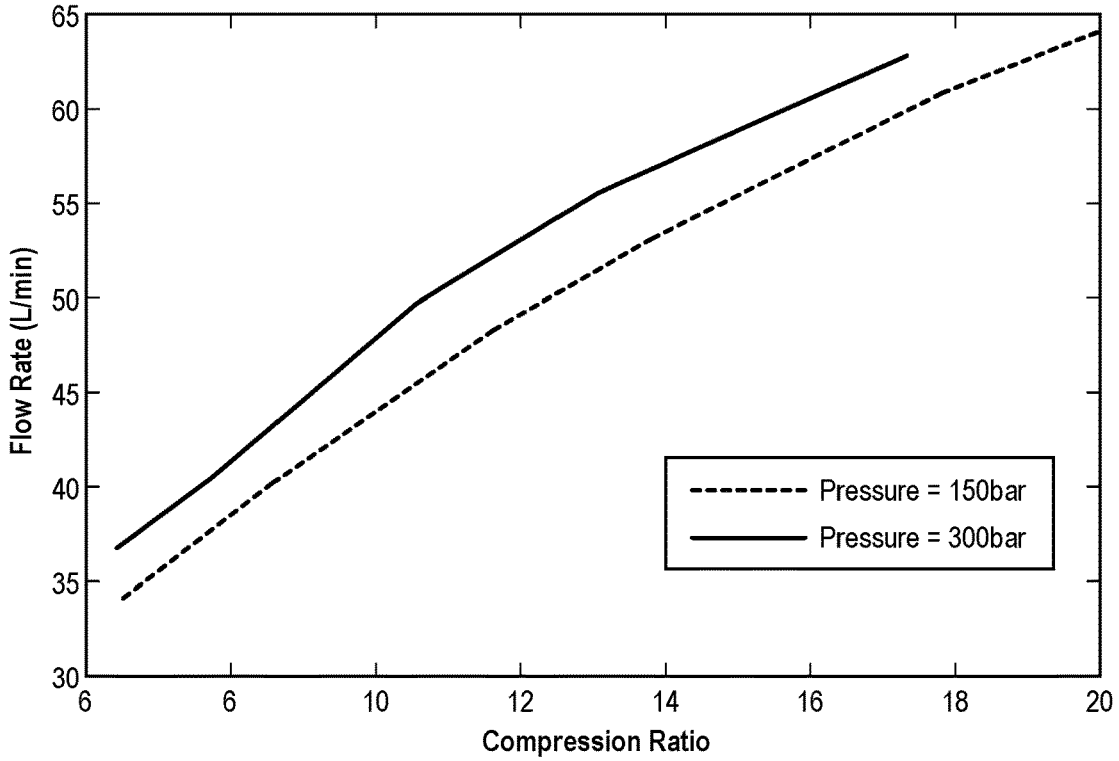
FIGS. 9A and 9B provide simulation test results showing an example of operational performance of an example HFPE under frequency-based control.
Figure 9B:
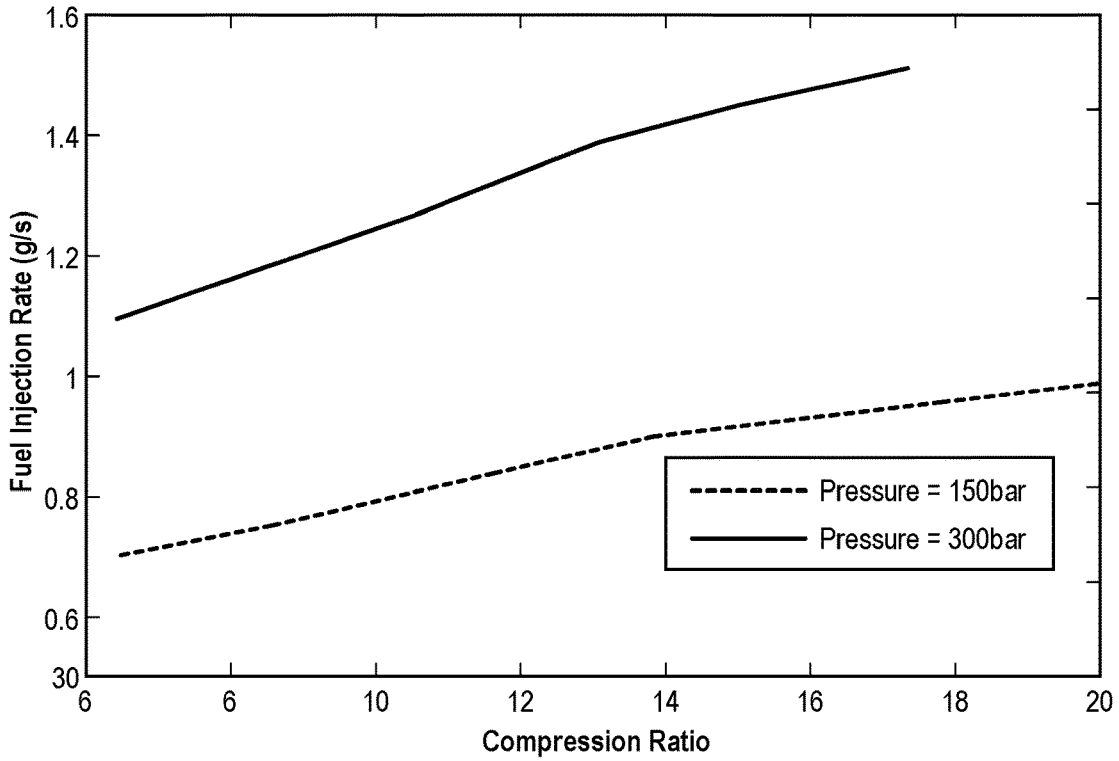
Figure 10A:
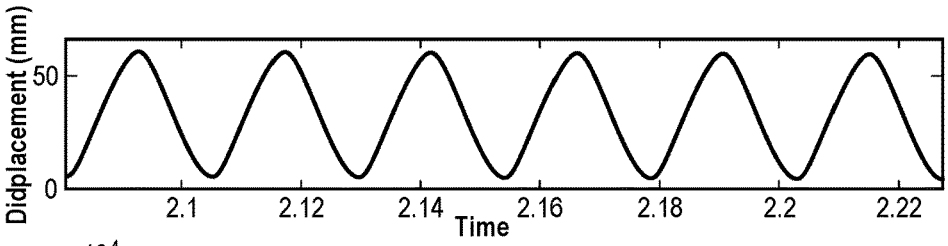
FIGS. 10A-10D are simulation test results showing an example of operational performance of an example HFPE regulated by the displacement-based control.
Figure 10B:
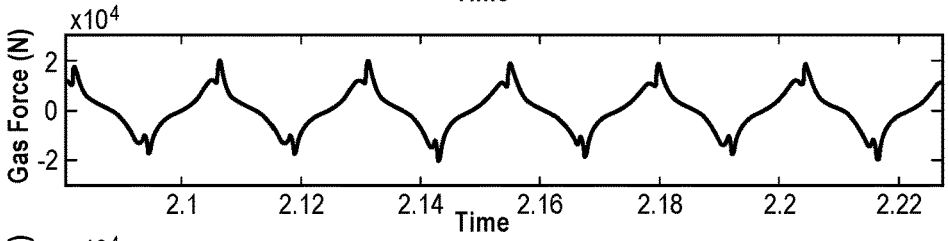
Figure 10C:
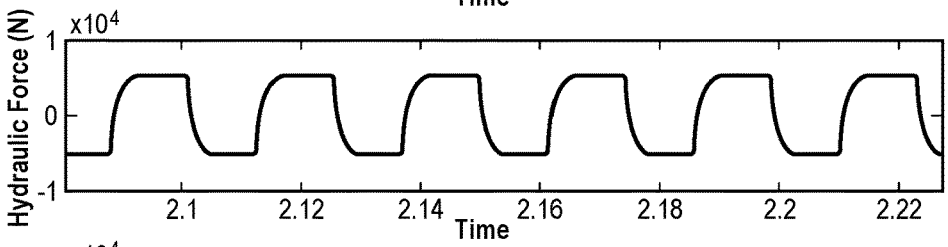
Figure 10D:
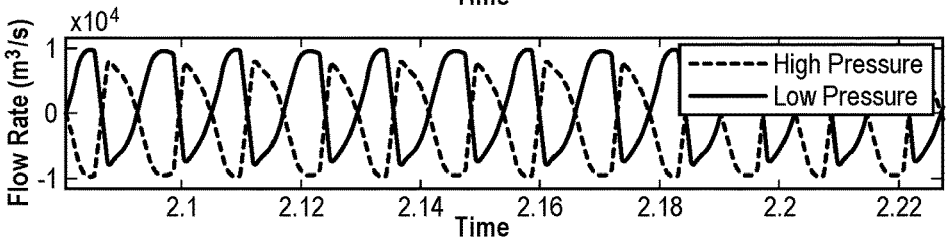

FIGS. 9A and 9B provide simulation test results showing an example of operational performance of the example HFPE 200 under frequency-based control. FIGS. 9A-9B show that the HFPE 200 can vary its output flow rate in a range at a specific load pressure by changing the target value of the CR and precisely controlling the fuel injection amounts in each combustion cycle. As an example, given the output hydraulic pressure as 150 bar, the output flow rate of the HFPE 200 can be regulated in the range of 35 L/min to 65 L/min, while the corresponding target CR ranges from 6 to 20.

Still referring to FIGS. 9A and 9B, the fuel injection has the same rising tendency as the flow rate. This is consistent with the aforementioned analysis, where the chemical energy from the fuel are mainly converted to combustion energy, and then absorbed by the hydraulic HP source as the hydraulic energy.

Frequency-based control can independently control the flow rate and the output pressure, but the range of this controllability may be limited, in some cases, by the narrow window of the available CR. In some implementations, low CR may cause unstable combustion performance in the engine and high CR may raise challenges on the mechanical strength of the hardware. As a result, the common CR in current engines may range from about 6 to about 20. In such cases, the HFPE 200 can operate at relatively high flow rate working conditions with the frequency-based control.

Displacement-Based Control

In this method, the reference signal may be extracted from the piston trajectory of one set of frequency-based control data. Since the output hydraulic chamber is connected to the HP for the entire stroke in the frequency based control, such a trajectory is expected to reach a high relative equivalent displacement (RED) value under the control of virtual crankshaft.

Simulation is conducted using parameters in Table. 1.

Table 1. Simulation Parameter of Displacement Based Control

TABLE 1

Simulation Parameter of Displacement Based Control

| Parameter | Description | Value |
|---|---|---|
| $A_{ref}$ | Reference amplitude | 52 mm |
| $f_{ref}$ | Reference frequency | 40 Hz |
| $P_{high}$ | HP source pressure | 379 Bar |
| $P_{low}$ | LP source pressure | 13.8 Bar |

A specific stable operation performance of the HFPE 200 is shown in FIG. 10. FIGS. 10A-10D are simulation test results showing an example of operational performance of the example HFPE 100 regulated by the displacement-based control. As shown, the net hydraulic force is controlled to counteract the net combustion chamber force, so that the piston is able to track the prescribed reference. Meanwhile, the output flow rate to the HP source 230, represented by the solid line in FIGS. 10A-10D, varies between about 1×10-3 m3/s and about −0.87×10-3 m3/s within a stroke. The negative instantaneous flowrate indicates that high pressure oil is going into the intake chamber(s) and assisting the piston motion.

Figure 11:
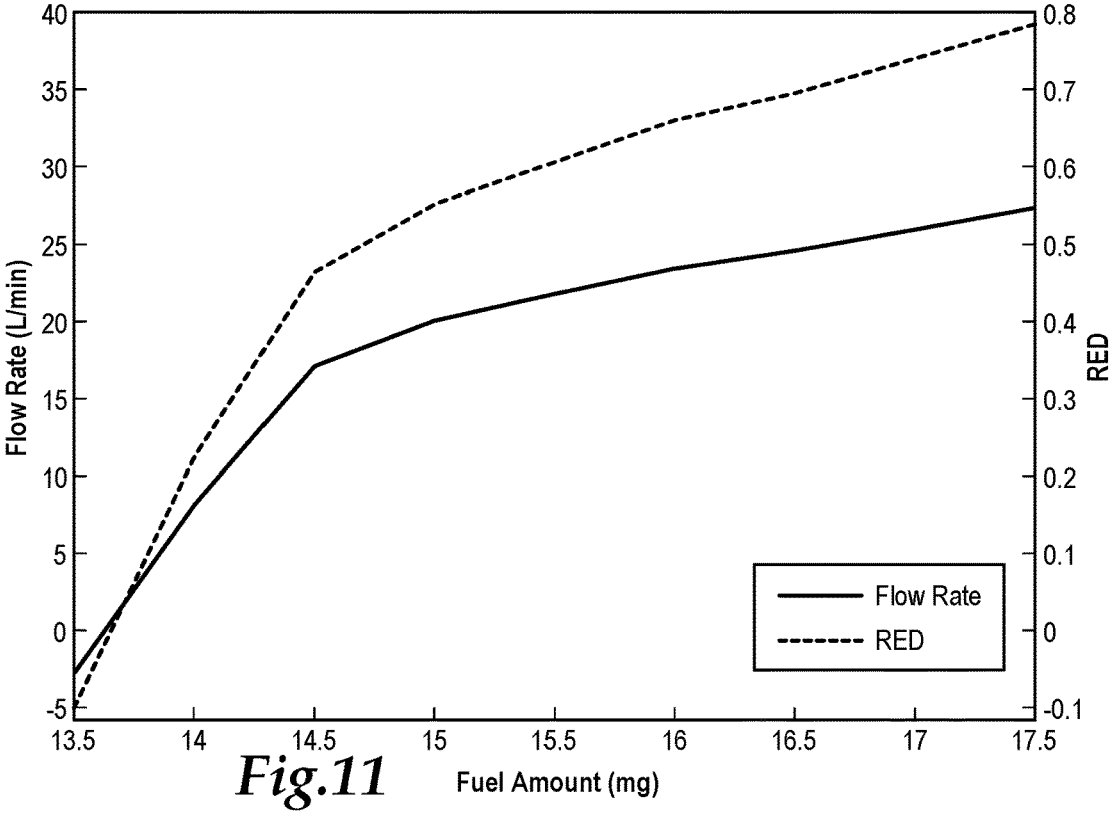
FIG. 11 shows a graph of flow rate and relative equivalent displacement (RED) for different fuel amounts of an example HFPE under displacement-based control.

FIG. 11 shows a graph of flow rate and relative equivalent displacement (RED) for different fuel amounts of an example HFPE under displacement-based control.

The simulation result for different fuel amounts along the same piston trajectory reference is shown in FIG. 11, where the solid line stands for average flow rate and the dashed line stands for the RED. The slight difference between the two is caused by different tracking performance, and consequentially different actual CR. As expected, the flow rate increases with the fuel injection amount per stroke.

When fuel injection is too small, e.g. less than 13.7 mg in this example, the HFPE 200 generates a negative output flow rate, which means the engine has to extract energy form the HP source 230 to assist the piston tracking instead of outputting energy to the HP source 230. In other words, the corresponding combustion energy cannot sustain the piston motion for this reference.

Figure 12A:
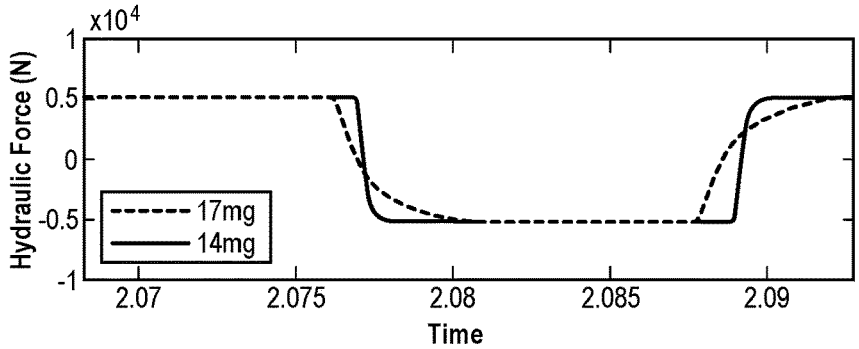
FIGS. 12A and 12B show example operational performance of an example HFPE under displacement-based control.
Figure 12B:
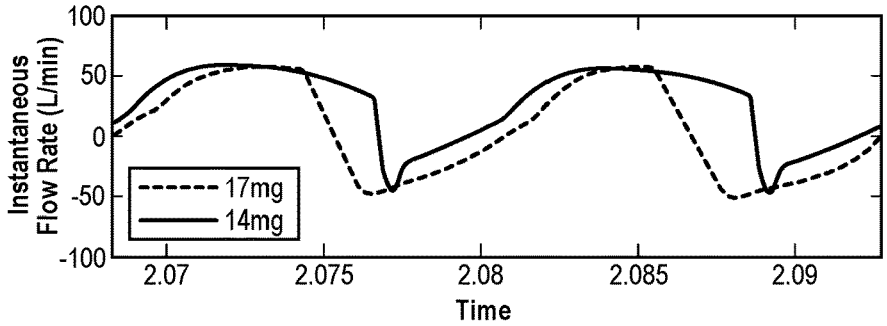

FIGS. 12A and 12B show example operational performance of an example HFPE under displacement-based control. More specifically, FIGS. 12A and 12B show the net hydraulic force and fluid flow into the HP source 230 under 17 mg and 14 mg fuel amount cases. When the fuel injection amount is larger, the servo valve 250 connects the output chamber to the HP source 230 for a longer time, thus providing the maximal hydraulic resist force for a longer duration as well as producing a larger output flow rate. This is consistent with the result shown in FIG. 11.

In sum, the simulation results provided herein show that for a given load pressure, using the displacement-based method, the HFPE 200 can produce different output flow rates according to different fuel injection amounts.

In some cases, due to its low mass inertia and compact structure, which combines the engine and the hydraulic pump as one device, the HFPE 200 can be considered as a highly viable fluid power source for mobile applications, especially for off-road vehicles. Attributed to the virtual crankshaft mechanism, the HFPE 200 can achieve active piston motion control via automatically adjusting the opening area of the servo valve 2500 embedded on the engine. As a result, any appropriate prescribed piston trajectory reference can be tracked precisely and robustly. The virtual crankshaft mechanism can allow the FPE to operate as a digital, throttling-less fluid power source by leveraging the freedom of its piston motion. By designing and implementing an appropriate piston trajectory reference and adjusting the fuel injection amount, the methods and system provided herein allow the HFPE 200 to produce different required output flow rates at any appropriate hydraulic load pressure. Theoretical principle and the working procedure of the control method provided herein are discussed further below.

In order to better explain the theoretical principle of this control method, the HFPE operation in its simplest form (see FIG. 5), of which the pistons 510, as a mass object, m, is vibrated by two forces, namely the in-cylinder gas force $F_{gas}$ 512 and the hydraulic force $F_{hydraulic}$ 514.

a) In-Cylinder Gas Force

By given the geometric specification of the HFPE 200, the in-cylinder gas force $F_{gas}$ 512 can be easily derived from the in-cylinder gas pressure $P_{gas}$. In addition, the in-cylinder gas pressure $P_{gas}$ can be calculated via the first law of thermodynamics for the closed system (ignoring the scavenging process):

$$\dot{P}_{gas} = \frac{\gamma - 1}{V}\left[\dot{Q} - \frac{\gamma}{\gamma - 1} P_{gas}\dot{V}\right] \quad \text{EQ. 14}$$

where is the specific heat capacity ratio, V is the combustion cylinder volume and Q& is the release heat rate of combustion.

The in-cylinder gas pressure is varied by two aspects: one is the compression/expansion of the in-cylinder gas itself, which is indicated by the variation of cylinder volume V and thus the piston trajectory X; the other one is the combustion process Q which causes significance raise of the pressure inside the cylinder. For the sake of the convenience, the combustion process is assumed as an instantaneous exothermic process during which all the chemical energy from the fuel is released immediately at the top dead center (TDC) point. In other words, the combustion process, as well as the corresponding in-cylinder gas pressure raise, is only determined by the fuel injection amount $m_{fuel}$. In a sum, the in-cylinder gas force can be determined by giving the piston trajectory X and the fuel injection amount $m_{fuel}$ in this case. Furthermore, from the perspective of the energy conservation, the required fuel injection amount (input energy) can also be determined by the required output flow rate $Q_{req}$ and the load pressure $P_{load}$(output energy). Thus the in-cylinder gas force can be derived by knowing the piston trajectory X, output flow rate $Q_{req}$ and the load pressure $P_{load}$.

$$F_{gas} = f(X, m_{fuel}) = f(X, Q_{req}, P_{load}) \quad \text{EQ. 15}$$

(b) Hydraulic Force

Unlike the in-cylinder gas force $F_{gas}$, the hydraulic force $F_{hydraulic}$ possesses more freedom to be adjusted due to the existence of the servo valve in the HFPE 200. At first, an ideal case is considered herein aimed to elaborate the basic idea clearly. Some assumptions are proposed to form this ideal condition:

The opening area of the servo valve 250 is always at its maximum.

No throttling loss through the servo valve 250.

The hydraulic fluid is incompressible.

Due to these assumptions, the hydraulic pressure in the hydraulic chamber is either the load pressure $P_{load}$ or the tank pressure $P_t$ (assigned to be 0 for simplicity) depends on the sign of the control signal sending to the servo valve.

Figure 13:
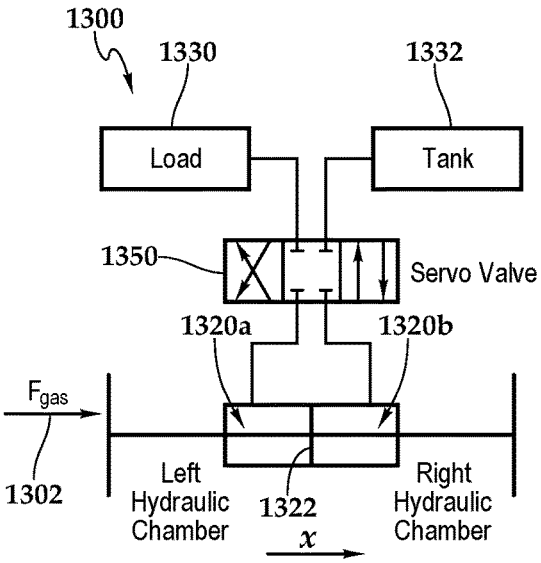
FIG. 13 shows a simplified schematic of an example hydraulic system in an HFPE.

FIG. 13 shows a simplified schematic of an example hydraulic system 1300 in an HFPE such as the example HFPE 200 of FIGS. 2A-2D.

The system 1300 includes a servo valve 1350. In some implementations, the servo valve 1350 can be the example servo valve 250 of FIGS. 2A-2D. In general, there are two function modes for the servo valve 1350 during one stroke.

In the illustrated example, the combustion occurs in the first combustion chamber (e.g., the combustion chamber 201*a*) and provides a combustion force $F_{gas}$ 1302 that pushes a hydraulic piston 1310 from the left to the right side in the illustrated example.

If a first control signal is send to the servo valve 1350, the servo valve 1350 in a first configuration (e.g., crossover), in which a right hydraulic chamber 1320*b* is connected to a load 1330 and a left hydraulic chamber 1320*a* is connected to a tank 1332. In this case, high pressure hydraulic oil in the right hydraulic chamber 1320*b* resists the movement of a piston 1322 and produces the output flow rate $Q_{resist}$ to the load 1330.

In contrast, if a second control signal is sent to the servo valve 1350, the servo valve 1350 works second configuration (e.g., flow though), and the right hydraulic chamber 1330*b* is fluidly connected to the tank 1332 and the left hydraulic chamber 1320*a* is fluidly connected to the load 1330. In this case, high pressure hydraulic oil, coming from the load 1330, flows into the left hydraulic chamber 1320*a* to help move the piston 1322 forward. The return flow rate is assigned as $Q_{help}$ and defines the working case as the help mode of the servo valve 1350.

If control signal changes between states within one stroke, then the effective output flow rate of this stroke should be:

$$Q_{effective} = Q_{resist} - Q_{help} \quad \text{EQ. 16}$$

In addition, at a fixed CR, the length of the stroke as well as the maximal displacement of the output flow $Q_{max}$ within the stroke is determined. From the perspective of the energy conservation, this maximal output flow at a specific load pressure will derive a corresponding maximal fuel injection amount, which is able to release sufficient chemical energy to produce such output power. If the required flow rate is less than $Q_{max}$, the desired fuel injection amount is reduced as well. In turn, the servo valve function can be switched from the resist mode to the help mode in real time to match the reduced combustion force and sustain the fixed CR. Considering equation (3), this switch gives us a comprehensive control means to match the $Q_{effective}$ to the $Q_{req}$ by selecting an appropriate switch position $X_{switch}$.

$$X_{switch}=g_1(CR,Q_{req},Q_{max})=g_2(X,Q_{req}) \quad \text{EQ. 17}$$

Furthermore, the hydraulic pressure $P_{hyd}$ as well as the $F_{hyd}$ can be determined by knowing the load pressure and the switch position $X_{switch}$. (E.g., assuming the servo valve 1322 works at resist mode at first then change to the help mode in the same stroke).

(c) Piston Trajectory Design

From the Newton 2nd law, the total force $F_{total}$ which regulates the piston 1322 following the piston trajectory is achieved accordingly.

$$F_{total}=F_{gas}+F_{hydraulic}=\ddot{X}\cdot m \quad \text{EQ. 18}$$

However, from (2) and (5), both the in-cylinder gas force $F_{gas}$ and the hydraulic force $F_{hydraulic}$ are functions of the piston trajectory X, output flow rate $Q_{req}$ and the load pressure $P_{load}$. By plugging (2) and (5) into (6) and arranging the corresponding equation accordingly, the following can be derived:

$$f(x,Q_{req},P_{load})+g(X,Q_{req},P_{load})=\ddot{X}\cdot m \Rightarrow x=\Phi(Q_{req},P_{load}) \quad \text{EQ. 19}$$

In other word, combining the output flow rate $Q_{req}$ and the load pressure $P_{load}$ can uniquely determine the corresponding piston trajectory x for the HFPE 200.

Taking the dynamic behavior of the servo valve 1350 into account, the rate of hydraulic pressure in the hydraulic chamber can be derived as:

$$\dot{P}_{hyd}=\frac{\beta}{V_{hyd}}\left[A_{hyd}\dot{X}-Q_{hyd}\right] \quad \text{EQ. 20}$$

Where β is bulk modulus of the fluid, $V_{hyd}$ is the volume of the hydraulic chamber, $A_{hyd}$ is the cross-section area of the hydraulic chamber.

From (8), the following can be achieved:

$$Q_{hyd}=-\frac{V_{hyd}\cdot\dot{P}_{hyd}}{\beta}+A_{hyd}\dot{X} \quad \text{EQ. 21}$$

Furthermore, using the orifice equation, the corresponding control signal of the servo valve 1350 can be achieved. One thing needs to be mentioned that the servo valve 1350 can operate in two function modes, namely resist mode and help mode, which depends on the direction of the desired flow rate $Q_{hyd}$.

$$u=\begin{cases}\dfrac{Q_{hyd}}{K_{servo}\cdot\sqrt{\dfrac{2(P_{hyd}-P_{load})}{\rho_{fluid}}}}, & Q_{hyd}>0 \quad \text{resist}\\[2ex] \dfrac{Q_{hyd}}{K_{servo}\cdot\sqrt{\dfrac{2(P_{hyd}-P_{t})}{\rho_{fluid}}}}, & Q_{hyd}<0 \quad \text{help}\\[2ex] 0 & \text{otherwise}\end{cases} \quad \text{EQS. 22, 23}$$

where $K_{servo}$ is the effective area of the servo valve 1350, $\rho_{fluid}$ is the fluid density.

From (10), the desired control signal u for the servo valve 1350 by given the $P_{load}$ can be achieved and by knowing the control signal u, the effective flow rate in this specific stroke $Q_{effective}$ can also be achieve, which is the algebraic sum of the $Q_{hyd}$ during the entire stroke. From the equation (15), (22) and (23), the effective flow rate $Q_{effective}$ is a function of the piston trajectory X, fuel injection amount $m_{fuel}$ and the required load pressure $P_{load}$, as shown in (24).

$$Q_{effective}=f(X,m_{fuel},P_{load}) \quad \text{EQ. 24}$$

If the $Q_{desired}$ is set as the $Q_{effective}$, in (24), another relationship between all of these parameters can be achieved.

$$X=g(Q_{desired},m_{fuel},P_{load}) \quad \text{EQ. 25}$$

With the knowledge of equation (25), an optimization process is designed to obtain the optimal X which give us the least throttling loss during the entire process.

EXAMPLES

Figure 14:
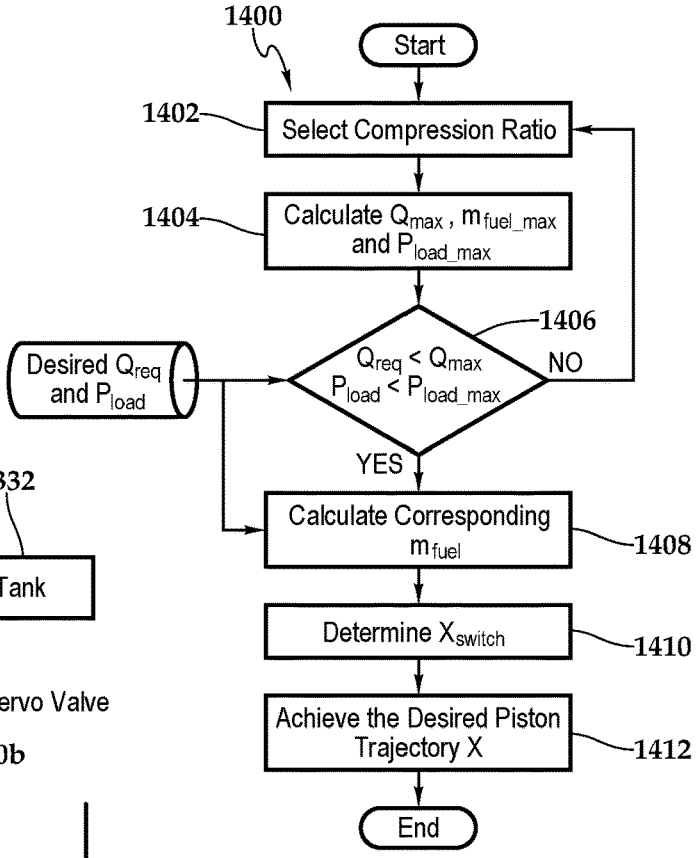
FIG. 14 shows a flow chart of an example displacement-based control process of an example HFPE.

FIG. 14 shows a flow chart of an example displacement-based control process 1400 of an example HFPE such as the example HFPE 200 of FIGS. 2A-2D.

Advantages of the processes provided herein include achieving independent pressure and flow rate control of the HFPE 200. In some cases, the processes provided herein can be based on the assumption that the servo valve 250 of the HFPE 200 operates in ideal condition, as will be further discussed herein.

At 1402, a compression ratio is selected. At 1404, for a given compression ratio, the maximal output flow rate $Q_{max}$, the maximal fuel injection amount $m_{fuel_max}$ and thus the maximal working load pressure $P_{load_max}$ are determined.

The selected compression ratio also determines the stroke length L.

In some examples, due to the compact structure of the HFPE 200, this L can also be the stroke length of the hydraulic pump. Therefore the maximal output flow rate can be given as $Q_{max}=A_{hyd}\cdot L$.

By knowing the geometric specification of the combustion chamber in the HFPE 200, the maximal volume of the intake air in the combustion chamber can be commuted. The maximal fuel injection amount may be the stoichiometric ratio to such an intake air. More fuel injection than this value generally will not produce any extra power due to the lack of oxygen-carrying fresh air.

From the perspective of the energy conservation, all the chemical energy from the fuel should be converted to the produced fluid power. In other word, $P_{load_max}=m_{fuel_max}\cdot Q_{LHV}/Q_{max}$ At 1406, a check is made to determine if the required flow rate $Q_{req}$ and working load pressure $P_{load}$ are less than the $Q_{max}$ and the $P_{load_max}$ respectively. If not, the compression ratio may be reselected at 1402 to fulfill this requirement.

At 1408, based on the $Q_{req}$ and $P_{load}$, the required fuel injection amount $m_{fuel}$ based upon the principle of energy conservation can be determined.

At 1410, based on the $Q_{max}$, $Q_{req}$ and the selected CR, the corresponding $X_{switch}$ can be determined by plugging all the required parameters into equation (17).

At 1412, plugging $X_{switch}$, $Q_{req}$ and $P_{load}$ into equation (19), the associated piston trajectory X can be determined for this specific working condition.

Figure 15A:
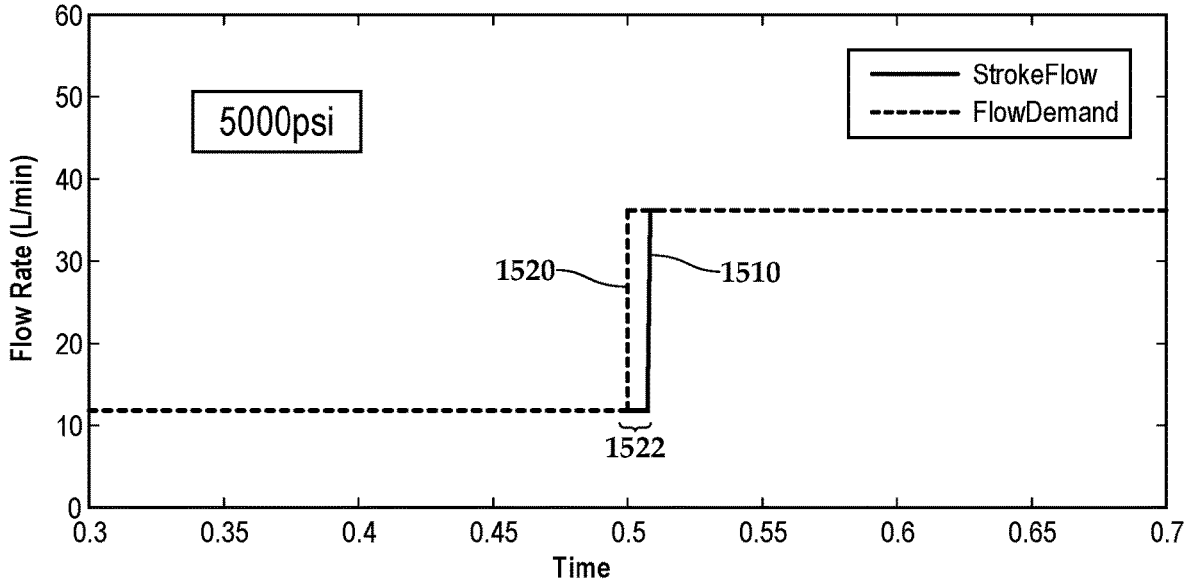
FIGS. 15A-15D are charts of example simulation results.
Figure 15B:
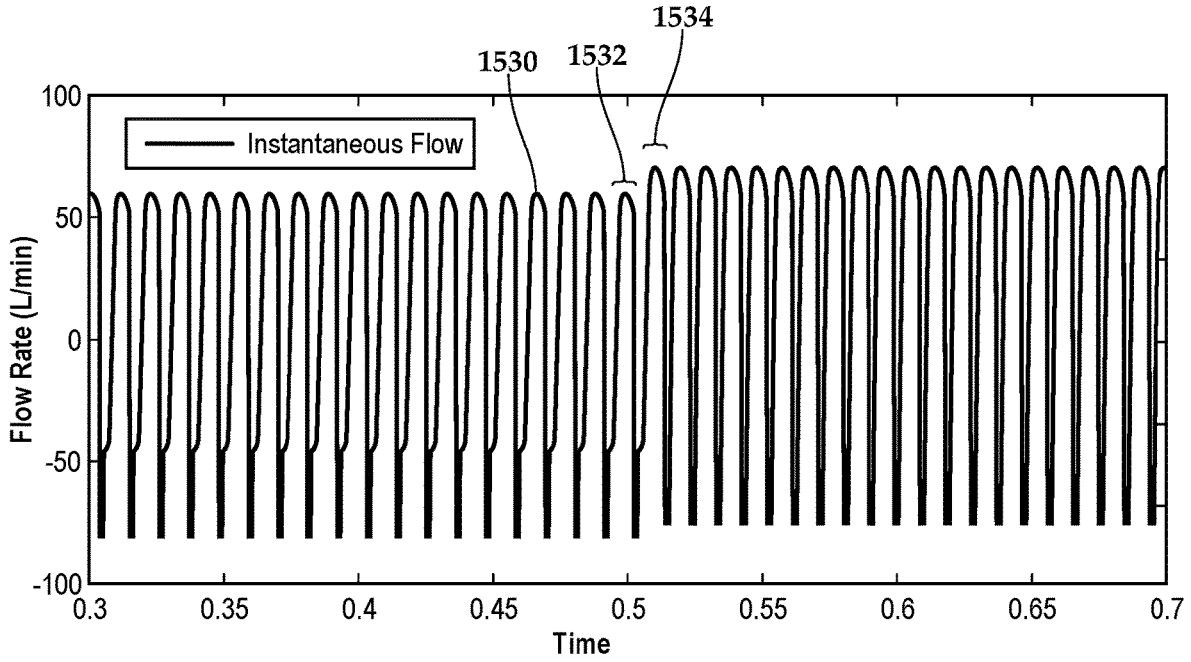

FIGS. 15A-15D are charts of example simulation results. FIGS. 15A and 15B show the results of a simulated system with a 5000 psi fluid load. FIG. 15A is a chart of fluid flow rate over time on a per-stroke basis (e.g., the total amount of fluid output in a single stroke), and shows a comparison of stroke flow 1510 to flow demand 1520 (e.g., the amount of fluid delivered per stroke versus the desired amount of fluid per stroke). At the 0.50 s mark, the flow demand 1520 makes a step transition 1522 from about 11 L/min to about 35 L/min. The illustrated example shows that the stroke flow 1510 response exhibits a similar step response that meets the demand within less than 0.01 s. This example shows that the example HFPE 200 can provide a near-instantaneous control response.

The manner in which this near-instantaneous, step-like response is accomplished can be further explained by examining the simulated results shown in FIG. 15B. In the illustrated example, an instantaneous flow rate 1530 is shown. The instantaneous flow rate 1530 oscillates as a function of the oscillatory pumping action of the hydraulic piston (e.g., the example hydraulic pistons 224*a*-224 or 1322 of FIGS. 2A-2D and FIG. 13) and the switching action of the servo (e.g., the example servo 250) that switches the hydraulic chambers (e.g., the hydraulic chambers 4-6) between being fluidly connected to the load (e.g., the HP source 230) and away from the load (e.g., to the LP source 232).

As was discussed with regard to FIG. 15A, the change in the flow demand 1520 occurs at the 0.50 s mark. Referring back to FIG. 15B, the 0.50 s mark occurs during a pumping stroke represented by a waveform 1532. The HFPE's next opportunity to alter flow rate by selecting a different timing of the servo valve mid-stroke switching operation occurs during the next pumping stroke, represented by a waveform 1534. As shown in FIG. 15B, the waveform 1534 has a different shape in comparison to the waveform 1532, mainly due to the HFPE's ability to implement different servo valve switching timings for each pumping stroke. As such, the HFPE 200 is able to alter its instantaneous flow rate 1530 during a single pumping stroke (as seen in FIG. 15B), and therefore alter its total stroke flow 1510 in response to the step transition 1522 in the demand flow 1520 within the time needed to perform a complete pumping stroke. In the illustrated example of FIG. 15A, the 0.01 s lag approximates the period of the waveform 1534 shown in FIG. 15B.

Figure 15C:
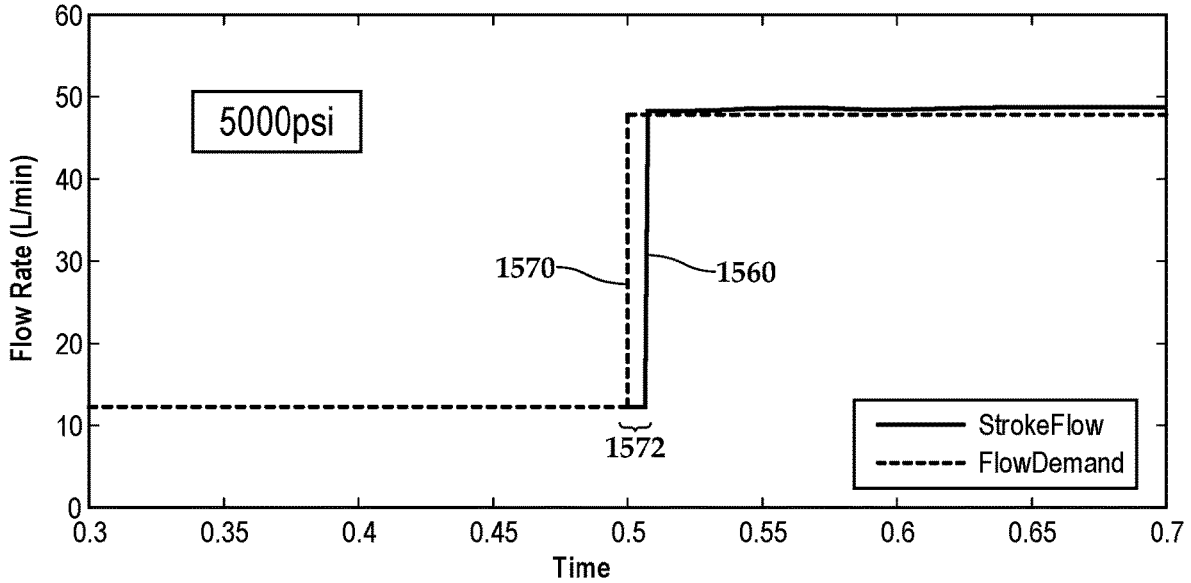
Figure 15D:
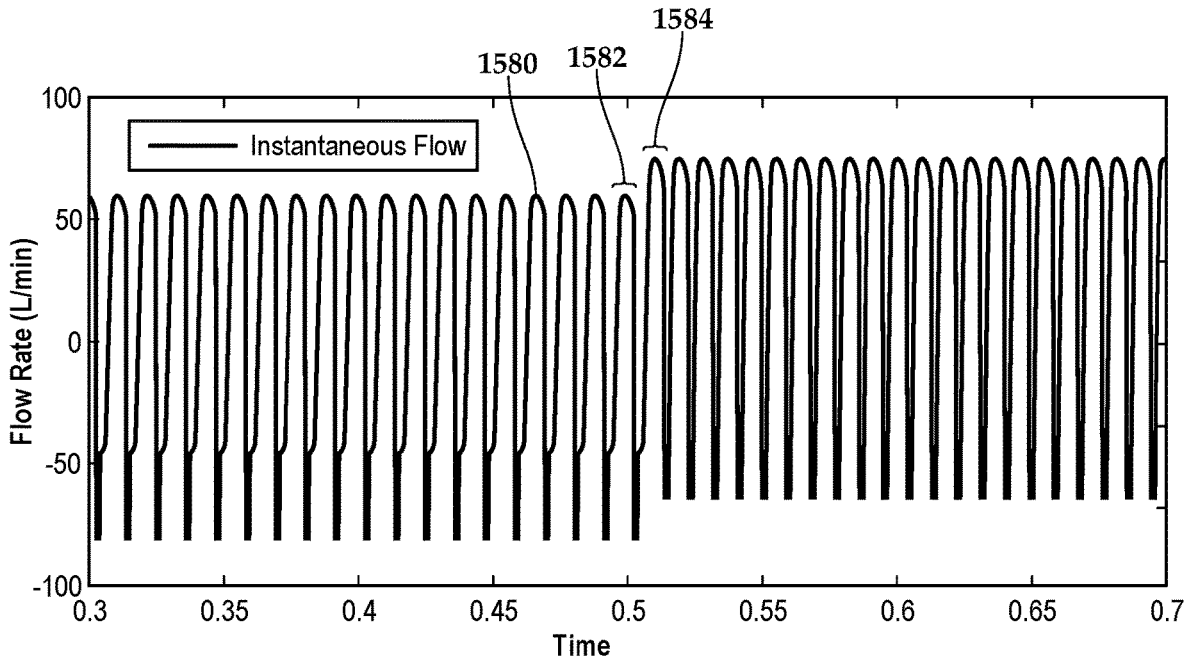

FIGS. 15C and 15D show the results of another simulation of the HFPE 200 with a 5000 psi fluid load. FIG. 15C is a chart of fluid flow rate over time on a per-stroke basis (e.g., the total amount of fluid output in a single stroke), and shows a comparison of stroke flow 1560 to flow demand 1570 (e.g., the amount of fluid delivered per stroke versus the desired amount of fluid per stroke). At the 0.50 s mark, the flow demand 1570 makes a step transition 1572 from about 11 L/min to about 48 L/min. The illustrated example shows that the stroke flow 1560 response exhibits a similar step response that meets the demand within less than 0.01 s. This example shows that the example HFPE 200 can provide a near-instantaneous control response.

The manner in which this near-instantaneous, step-like response is accomplished can be further explained by examining the simulated results shown in FIG. 15D. In the illustrated example, an instantaneous flow rate 1580 is shown. The instantaneous flow rate 1580 oscillates as a function of the oscillatory pumping action of the hydraulic piston (e.g., the example hydraulic pistons 224*a*-224 or 1322 of FIGS. 2A-2D and FIG. 13) and the switching action of the servo (e.g., the example servo 250) that switches the hydraulic chambers (e.g., the hydraulic chambers 4-6) between being fluidly connected to the load (e.g., the HP source 230) and away from the load (e.g., to the LP source 232).

As was discussed with regard to FIG. 15C, the change in the flow demand 1570 occurs at the 0.50 s mark. Referring back to FIG. 15D, the 0.50 s mark occurs during a pumping stroke represented by a waveform 1582. The HFPE's next opportunity to alter flow rate by selecting a different timing of the servo valve mid-stroke switching operation occurs during the next pumping stroke, represented by a waveform 1584. As shown in FIG. 15D, the waveform 1584 has a different shape in comparison to the waveform 1582, mainly due to the HFPE's ability to implement different servo valve switching timings for each pumping stroke. As such, the HFPE 200 is able to alter its instantaneous flow rate 1580 during a single pumping stroke (as seen in FIG. 15D), and therefore alter its total stroke flow 1560 in response to the step transition 1572 in the demand flow 1570 within the time needed to perform a complete pumping stroke. In the illustrated example of FIG. 15C, the 0.01 s lag approximates the period of the waveform 1584 shown in FIG. 15D.

Figure 16:
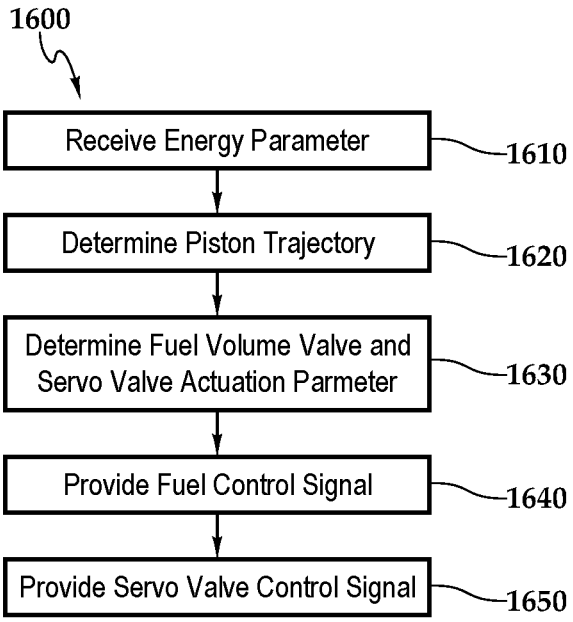
FIG. 16 shows a flow chart of another example process for operating an example HPFE.

FIG. 16 shows a flow chart of another example process 1600 for operating an example HPFE such as the example HFPE 200 of FIGS. 2A-2D. In some implementations, the process 1600 can be performed by the example controller 100 of FIG. 1. At 1610 an energy parameter that is representative of an amount of fluid energy to be output by the engine, and a measured fluid pressure value of a fluid load of the engine, is received at an engine controller for a hydraulic free piston engine. For example, the measured load pressure 102 and the target flow rate 104 can be received by the IPFC 110.

At 1620, a piston trajectory of a piston within a hydraulic chamber of the engine is determined by the engine controller. For example, the IPFC 110 can determine the piston trajectory X according to Equation 25.

At 1630 a fuel volume value and a servo valve actuation parameter are determined by the engine controller based on the energy parameter and the measured fluid pressure value. In some implementations, determining, by the engine controller, a fuel volume value and a servo valve actuation parameter, based on the energy parameter and the measured fluid pressure value can include balancing the fuel volume value and the servo valve actuation value such that the engine provides the amount of fluid energy. For example, the $Q_{desired}$ and $m_{fuel}$ of Equation 25 can be optimized for X.

In some implementations, determining, by the engine controller, a fuel volume value and a servo valve actuation parameter, based on the energy parameter and the measured fluid pressure value can include determining the fuel volume value based on the measured pressure and the energy parameter, and determining the servo valve actuation parameter based on the measured fluid pressure and a load energy parameter that is less than or equal to the energy parameter and is representative of an amount of fluid energy to be provided to the fluid load. For example, Equation 25 can be solved such that $m_{fuel}$ operates the HFPE 200 at a speed that satisfies $Q_{desired}$ plus an additional amount of energy (e.g., $Q_{desired}+Q_{extra}=Q_{total}$), such that the HPFE 200 can respond to changes in flow demand (e.g., flow demand 1520, 1570) above $Q_{desired}$, up to $Q_{total}$, in a near-instantaneous manner, such as within one pumping stroke as shown in FIGS. 15A-15D.

At 1640 a fuel control signal is provided by the engine controller to a fuel control device of the engine based on the fuel volume value. For example, the fuel volume amount signal 162 can be provided to a fuel injector or carburetor to control a flow of fuel to a combustion process for operating the example HFPE 200.

At 1650 a servo valve control signal based on the servo valve actuation parameter and the piston trajectory is provided by the engine controller to a servo valve in fluid communication with the hydraulic chamber and the fluid load, wherein the servo valve is responsive to the servo valve control signal to switch between a help mode configuration and a resist mode configuration. For example, the servo valve signal 160 can be provided to the servo valve 250, with is operable between a flow through configuration and a crossover configuration, in which the HP source 230 can be used to either help (e.g., motor) the HFPE 200 or resist (e.g., be powered by) the HFPE 200.

Figure 17:
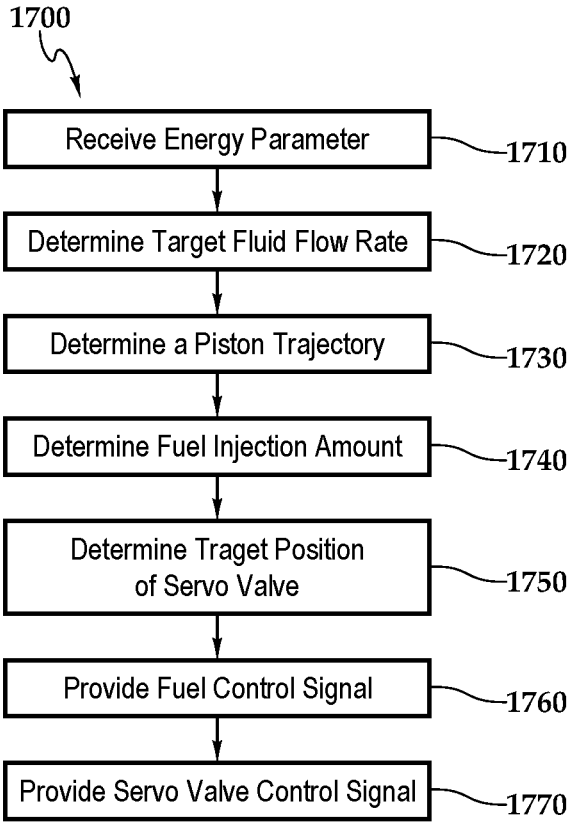
FIG. 17 shows a flow chart of another example process for operating an example HPFE.

FIG. 17 shows a flow chart of another example process for operating an example HPFE such as the example HFPE 200 of FIGS. 2A-2D. In some implementations, the process 1600 can be performed by the example controller 100 of FIG. 1.

At 1710 an energy parameter that is representative of an amount of energy to be output by the engine is received at an engine controller for a hydraulic free piston engine. For example, the measured load pressure 102 can be received by the IPFC 110.

At 1720 a target fluid flow rate per stroke of a hydraulic chamber containing a piston based on the energy parameter and a measured load pressure is determined by the engine controller. For example, the target flow rate 104 can be determined by the IPFC 110.

At 1730, a piston trajectory of the piston within the hydraulic chamber is determined by the engine controller based on (i) a dynamic trajectory model, (ii) the energy parameter, (iii) the measured load pressure, and (iv) the target fluid flow rate. For example, the IPFC 110 can determine the piston trajectory X according to Equation 25.

At 1740, a fuel injection amount is determined from the dynamic trajectory model. For example, the $Q_{desired}$ and $m_{fuel}$ of Equation 25 can be optimized for X.

At 1750 a target position of a servo valve is determined from the dynamic trajectory model. For example, the servo valve signal 160 can be determined.

At 1750 a fuel control signal is provided by the engine controller based on the fuel injection amount to a fuel control device. For example, the fuel volume amount signal 162 can be provided to a fuel injector or carburetor to control a flow of fuel to a combustion process for operating the example HFPE 200.

At 1760 the engine controller provides a servo valve control signal based on the piston trajectory to a servo valve in fluid communication with the fluid load, wherein the servo valve operates in a help mode and a resist mode. For example, the servo valve signal 160 can be provided to the servo valve 250, with is operable between a flow through configuration and a crossover configuration, in which the HP source 230 can be used to either help (e.g., motor) the HFPE 200 or resist (e.g., be powered by) the HFPE 200.

In some implementations, the determined desired piston trajectory can be determined by computing, from the dynamic trajectory model, a desired switching time of the servo valve based on the dynamic trajectory model. For example, IPFC 110 can determine the switching point 124.

In some implementations, controlling operation of the servo valve can include changing the position of the servo valve from a first configuration to a second configuration, or changing from the second configuration to the first configuration. The method of claim 1, wherein the position of the servo valve determines whether the servo valve operates in one of two function modes, wherein the two function modes comprising a resist mode and a help mode. For example, the servo valve signal 160 can be provided to the servo valve 250, with is operable between a flow through configuration and a crossover configuration, in which the HP source 230 can be used to either help (e.g., motor) the HFPE 200 or resist (e.g., be powered by) the HFPE 200.

In some implementations, the determined desired piston trajectory can be determined by computing, from the dynamic trajectory model, a hydraulic force. For example, the piston trajectory X of Equation 25 can be determined in part based on $Q_{desired}$ and $P_{load}$.

In some implementations, the hydraulic force value can be computed based on the desired load pressure, a cross-section area of a hydraulic chamber, and the position of the servo valve. For example, energy can be described as a function of pressure and flow (e.g., $Q=P_{load}*F$), therefore flow is a function of energy and pressure (e.g., $F=Q/P_{load}$). Flow in a hydraulic cylinder is also a product of cylinder geometry, such as the stroke length of the piston and the cross-sectional area across the piston. In the HPFE 200, the flow is also the product of when the servo valve 250 is switched during the stroke of the piston (e.g., to flow an amount that is equal to or less than the total volume available during each pumping stroke).

In some implementations, a magnitude of the control signal can determine whether to change the position of the servo valve. For example, the servo valve signal 160 can vary between 0-10V, and the servo valve 250 can switch to one of the first or second configuration in response to signal voltages over 7V and switch to the other configuration at voltages below 3V.

In some implementations, the reference trajectory signal can include a data set including a collection of piston location points and corresponding time values. In some implementations, the data set can describe the desired piston trajectory at a start point, an end point, and a collection of intermediate points between the start and end points. In some implementations, the collection of intermediate points between the start and end points can form a non-linear relationship as a function of time. In some implementations, the collection of intermediate points between the start and end points can describe how the piston moves within the at least one hydraulic chamber between the start and end points. In some implementations, the collection of intermediate points can determine how the piston moves when the piston located in an intermediate location within the hydraulic chamber that is independent of how the piston moves at the start and end points. For example, the piston trajectory can be based in part on a predetermined or dynamically determined lookup table of values that describe the relationships between various piston positions and times that the piston will be at those positions.

In some implementations, the desired piston trajectory can include a position of the piston within the at least one hydraulic chamber as a function of time. For example, the movement of the piston is oscillatory and periodic, based in part on the speed of the combustion cycle of the HFPE 200 (e.g., which itself is a function of the volume of fuel being provided to the engine) and on the load. By knowing the path of motion of the piston and the frequency of the motion, the position of the instantaneous position of the piston can be determined.

In some implementations, the hydraulic free piston engine can include multiple hydraulic chambers, and the position of the servo valve can determine which hydraulic chambers are connected to a high pressure source and which hydraulic chambers are connected to a low pressure source. For example, the example HFPE 200 includes the hydraulic chambers 1-6, and the servo valve 250 can switch to direct groupings of the chambers (e.g., 1-3 and 4-6) between the HP load 230 and the LP 232.

In some implementations, outputting the reference trajectory signal to control operation of the servo valve can include adjusting a current piston trajectory to the determined desired piston trajectory. For example, output of the IPFC 110 can be updated as the measured load pressure 102 and/or the target flow rate 104 change.

In some implementations, the process 1700 can be executed with every stroke cycle of the piston within the at least one hydraulic chamber.

In some implementations, the process 1700 can include a check function, the check function that includes determining, by the engine controller, a maximal load pressure and a maximal fluid flow rate of the engine, and comparing the current load pressure and fluid flow rate to the maximal load pressure and the maximal fluid flow rate, wherein, if the current load pressure and fluid flow rate are greater than the maximal load pressure and the maximal fluid flow rate, the energy parameter is reselected. For example, the piston trajectory X may be reselected to reduce total energy output if $Q_{desired}$ exceeds a predetermined maximum pressure and flow of the load (e.g., the fluid circuit connecting the HFPE 200 to the HP load 230 has a maximum rating for pressure and or flow).

In some implementations, the energy parameter can include a compression ratio value for the at least one hydraulic chamber. In some implementations the receiving the energy parameter can include receiving the compression ratio value from a list of acceptable compression ratio values.

For example the compression ratio value 122 can be a predetermined value that is based on the compression ratings of the combustion chambers 201*a* and 201*b*.

In some implementations, the required fuel amount is a fuel mass. For example, the system 100 may operate to provide the fuel value 162 to a fuel metering device to control the mass or volume of fuel that is provided to the combustion chambers 201*a* and 201*b* for each combustion cycle.

In some embodiments, a method for generating a control-signal for a piston-free engine can include receiving, at an engine controller for a piston-free engine, an energy parameter that indicates an amount of energy to be output by the engine; receiving, at the engine controller, a desired load pressure and a required fluid flow rate per stroke of at least one hydraulic chamber containing a piston; determining, at the engine controller, a desired piston trajectory of the piston within the at least one hydraulic chamber; and outputting, by the engine controller, a reference trajectory signal to control operation of a servo valve and a fuel injector to move the piston within the at least one hydraulic chamber at the determined desired piston trajectory. The determining of the desired piston trajectory of achieve can be based on inputting into a dynamic trajectory model the energy parameter and the desired load pressure, and the required fluid flow rate; and computing, from the dynamic trajectory model, a required fuel injection amount; and determining, from the dynamic trajectory model, a required position of a servo valve.

In some cases, the determined desired piston trajectory can comprise computing, from the dynamic trajectory model, a desired switching time of the servo valve based on the dynamic trajectory model. The controlling operation of the servo valve may include changing the position of the servo valve from a bottom position to a top position, or changing a top position to a bottom position. In some cases, the position of the servo valve can determine whether the servo valve operates in one of two function modes, wherein the two function modes comprising a resist mode and a help mode. The determined desired piston trajectory can comprise computing, from the dynamic trajectory model, a hydraulic force. In some cases, the hydraulic force value is computed based on the desired load pressure, a cross-section area of a hydraulic chamber, and the position of the servo valve. A magnitude of the control signal can determine whether to change the position of the servo valve.

In some cases, the reference trajectory signal comprises a data set including a plurality of piston location points and corresponding time values. In some cases, the data set describes the desired piston trajectory at a start point, an end point, and a plurality of intermediate points between the start and end points. In some cases, the plurality of intermediate points between the start and end points forms a non-linear relationship as a function of time. The plurality of intermediate points between the start and end points can describe how the piston moves within the at least one hydraulic chamber between the start and end points. The plurality of intermediate points can determine how the piston moves when the piston located in an intermediate location within the hydraulic chamber that is independent of how the piston moves at the start and end points. In some cases, the desired piston trajectory can include a position of the piston within the at least one hydraulic chamber as a function of time.

In some cases, the piston-free engine can comprise multiple hydraulic chambers, and wherein the position of the servo valve determines which hydraulic chambers are connected to a high pressure source and which hydraulic chambers are connected to a low pressure source. The outputting the reference trajectory signal to control operation of the servo valve may comprise adjusting a current piston trajectory to the determined desired piston trajectory. The method may be executed with every stroke cycle of the piston within the at least one hydraulic chamber.

In some cases, the methods provided herein can further comprising a check function, the check function comprising determining, by the engine controller, a maximal load pressure and a maximal fluid flow rate of the engine; and comparing the current load pressure and fluid flow rate to the maximal load pressure and the maximal fluid flow rate; wherein, if the current load pressure and fluid flow rate are greater than the maximal load pressure and the maximal fluid flow rate, the energy parameter is reselected. In some cases, the energy parameter can comprise a compression ratio value for the at least one hydraulic chamber. In some cases, the receiving the energy parameter can comprise receiving the compression ratio value from a list of acceptable compression ratio values. In some cases, the required fuel amount can be a fuel mass.

In some cases, a piston-free engine system that includes at least one engine combustion chamber, a piston movably disposed within at least one hydraulic chamber, a servo valve for connecting or disconnecting the piston to the load device; and an engine controller in communication with the servo valve. The piston can be operatively connected with a load device and to the at least one engine combustion chamber. The engine controller can be programmed to receive a compression ratio of the engine; receive the desired load pressure and fluid flow rate per stroke of the piston within the at least one hydraulic chamber; and determine a desired piston trajectory of the piston within the at least one hydraulic chamber to achieve based on inputting into a dynamic trajectory model the energy parameter and the desired load pressure, and the required fluid flow rate;

computing, from the dynamic trajectory model, a required fuel injection amount; and determining, from the dynamic trajectory model, a required position of a servo valve. The engine controller can be programmed to output a reference trajectory signal to control operation of a servo valve and a fuel injector to move the piston within the at least one hydraulic chamber at the determined desired piston trajectory.

The novel control methods provided herein for realizing HFPE as a throttle-less mobile fluid power source, were tested with simulation verifications provided herein. The simulation results clearly show that both the frequency-based control and the displacement-based control can achieve the control objective of independently adjusting the output flow rate and the load pressure. The HFPE's good potential as a mobile fluid power source is thus demonstrated. Generally, the displacement based control has a wider operation range and a better robustness due to the existence of the virtual crankshaft mechanism. Also, the displacement based method can select the desired CR independently from the required flow rate, thus has better potential to provide higher combustion efficiency.

In some cases, for both control method, only the steady state performances may be considered in the simulation. In some cases, there may be a control challenge on the transient performance of the HFPE when the load pressure and flow rate demand change in real time. For displacement-based control, in some cases, the maximal available flow rate can be related to the shape of the prescribed reference. Thus, systems and methods provided herein may incorporate an optimized reference shape for the displacement-based control in order to achieve the optimized performance of the HFPE.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

LIST OF REFERENCES

[1] Backé, W., "The Present and Future of Fluid Power," Proceedings of the Institution of Mechanical Engineers, Part I: Journal of Systems and Control Engineering, vol. 207, issue. 4, pp. 193-212, 1993.

[2] Wang, T. and Wang, Q., "An Energy-saving Pressure-compensated Hydraulic System with Electrical Approach," IEEE/ASME Trans. Mechatronics, vol. 19, no. 2, pp. 570-578, 2014.

[3] Finzel, R. and Helduser, S. "Energy-efficient Electro-hydraulic Control Systems for Mobile Machinery/Flow Matching," in Proc. 6th Int. Fluid Power Conf. Dresden, Germany, 2008.

[4] Du, Can. "Variable Supply Pressure Electrohydraulic System for Efficient Multi-axis Motion Control" Diss. University of Bath, 2014.

[5] Schoenau, G. J., Burton, R. T. and Kavanagh, G. P., "Dynamic analysis of a variable displacement pump," Journal of Dynamic Systems, Measurement, and Control, vol. 112, issue. 1, pp. 122-132, 1990.

[6] Wang, L., "Adaptive Robust Control of Variable Displacement Pumps," in 6th Fluid Power Net International Annual PhD Symposium, West Lafayette, Ind., 2010.

[7] Mikalsen, R. and Roskilly, A. P., "A Review of Free-piston Engine History and Applications," Applied Thermal Engineering, Vol. 27, Issue. 14-15, pp. 2339-2352, October 2007.

[8] Li, K., Sadighi, A. and Sun, Z., "Active Motion Control of a Hydraulic Free Piston Engine," IEEE/ASME Trans., Mechatronics, vol. 19, Issue. 4, pp. 1148-1159, 2014.

[9] Achten, A. J., Oever, P. J. van den, P. J. and Vael, E. M., "Horsepower with Brains: The Design of the CHIRON Free Piston Engine", SAE Technical Paper Series, 2000-01-2545, 2000.

[10] Li, K., Zhang, C. and Sun, Z., "Precise Piston Trajectory Control for a Free Piston Engine," Control Engineering Practice, vol. 34, pp. 30-38, 2015.

[11] Tomizuka, M., Tsao, T. C. and Chew, K. K., "Analysis and Synthesis of Discrete-time Repetitive Controllers," ASME Trans. J. Dyn. Syst., Meas. Control, vol. 111, pp. 353-358, 1989.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method for operating a hydraulic free piston engine, the method comprising:

receiving, at an engine controller for a hydraulic free piston engine, an energy parameter that is representative of an amount of energy to be output by the engine, and;

determining, by the engine controller, a target fluid flow rate per stroke of a hydraulic chamber containing a piston based on the energy parameter and a measured load pressure;

determining, by the engine controller, a piston trajectory of the piston within the hydraulic chamber based on:

(i) a dynamic trajectory model;

(ii) the energy parameter;

(iii) the measured load pressure, and (iv) the target fluid flow rate;

determining, from the dynamic trajectory model, a fuel injection amount;

determining, from the dynamic trajectory model, a target position of a servo valve;

providing, by the engine controller, a fuel control signal based on the fuel injection amount to a fuel control device; and providing, by the engine controller and based on the piston trajectory, a servo valve control signal to a servo valve in fluid communication with the fluid load, wherein the servo valve operates in a help mode and a resist mode.

2. The method of claim 1, wherein the 'determined desired piston trajectory' comprises computing, from the dynamic trajectory model, a desired switching time of the servo valve based on the dynamic trajectory model.

3. The method of claim 1, wherein controlling operation of the servo valve comprises changing the position of the servo valve from a first configuration to a second configuration, or changing from the second configuration to the first configuration.

4. The method of claim 1, wherein the position of the servo valve determines whether the servo valve operates in one of two function modes, wherein the two function modes comprising a resist mode and a help mode.

5. The method of claim 1, wherein the 'determined desired piston trajectory' comprises computing, from the dynamic trajectory model, a hydraulic force.

6. The method of claim 5, wherein the hydraulic force value is computed based on the desired load pressure, a cross-section area of a hydraulic chamber, and the position of the servo valve.

7. The method of claim 1, wherein a magnitude of the control signal determines whether to change the position of the servo valve.

8. The method of claim 1, wherein the reference trajectory signal comprises a data set including a plurality of piston location points and corresponding time values.

9. The method of claim 8, wherein the data set describes the desired piston trajectory at a start point, an end point, and a plurality of intermediate points between the start and end points.

10. The method of claim 9, wherein the plurality of intermediate points between the start and end points forms a non-linear relationship as a function of time.

11. The method of claim 9, wherein the plurality of intermediate points between the start and end points describes how the piston moves within the at least one hydraulic chamber between the start and end points.

12. The method of claim 9, wherein the plurality of intermediate points are representative of how the piston moves when the piston located in an intermediate location within the hydraulic chamber that is independent of how the piston moves at the start and end points.

13. The method of claim 1, wherein the desired piston trajectory includes a position of the piston within the at least one hydraulic chamber as a function of time.

14. The method of claim 1, wherein the hydraulic free piston engine comprises multiple hydraulic chambers, and wherein the position of the servo valve determines which hydraulic chambers are connected to a high pressure source and which hydraulic chambers are connected to a low pressure source.

15. The method of claim 1, wherein 'outputting the reference trajectory signal to control operation of the servo valve' comprises adjusting a current piston trajectory to the determined desired piston trajectory.

16. The method of claim 1, wherein the method is executed with every stroke cycle of the piston within the at least one hydraulic chamber.

17. The method of claim 1, further comprising a check function, the check function comprising:

determining, by the engine controller, a maximal load pressure and a maximal fluid flow rate of the engine; and comparing the current load pressure and fluid flow rate to the maximal load pressure and the maximal fluid flow rate;

wherein, if the current load pressure and fluid flow rate are greater than the maximal load pressure and the maximal fluid flow rate, the energy parameter is reselected.

18. The method of claim 1, wherein the energy parameter comprises a compression ratio value for the at least one hydraulic chamber.

19. The method of claim 18, wherein receiving the energy parameter comprises receiving the compression ratio value from a list of acceptable compression ratio values.

20. The method of claim 1, wherein the required fuel amount is a fuel mass.

21. A hydraulic free piston engine system, the system comprising:

at least one engine combustion chamber;

a piston movably disposed within at least one hydraulic chamber, the piston being operatively connected with a load device and the piston operatively connected to the at least one engine combustion chamber; and a servo valve for connecting or disconnecting the piston to the load device; and an engine controller in communication with the servo valve; the engine controller being programed to:

receive a compression ratio of the engine;

receive the desired load pressure and fluid flow rate per stroke of the piston within the at least one hydraulic chamber;

determine a desired piston trajectory of the piston within the at least one hydraulic chamber to achieve based on:

inputting into a dynamic trajectory model:

the energy parameter; and the desired load pressure; and a target fluid flow rate;

determining, from the dynamic trajectory model, a fuel injection amount; and determining, from the dynamic trajectory model, a target position of a servo valve configured to operate in a help mode configuration and a resist mode configuration; and provide a reference trajectory signal to control operation of the servo valve and a fuel injector to move the piston within the at least one hydraulic chamber at the determined desired piston trajectory, wherein the servo valve is responsive to the reference trajectory signal to switch between the help mode configuration and the resist mode configuration.

22. A method for operating a hydraulic free piston engine, the method comprising:

receiving, at an engine controller for a hydraulic free piston engine, an energy parameter that is representative of an amount of fluid energy to be output by the engine, and a measured fluid pressure value of a fluid load of the engine;

determining, by the engine controller, a piston trajectory of a piston within a hydraulic chamber of the engine;

determining, by the engine controller, a fuel volume value and a servo valve actuation parameter, based on the energy parameter and the measured fluid pressure value;

providing, by the engine controller, a fuel control signal to a fuel control device of the engine based on the fuel volume value; and providing, by the engine controller and based on the servo valve actuation parameter and the piston trajectory, a servo valve control signal to a servo valve in fluid communication with the hydraulic chamber and the fluid load, wherein the servo valve is responsive to the servo valve control signal to switch between a help mode configuration and a resist mode configuration.

23. The method of claim 22, wherein determining, by the engine controller, a fuel volume value and a servo valve actuation parameter, based on the energy parameter and the measured fluid pressure value further comprises balancing the fuel volume value and the servo valve actuation value such that the engine provides the amount of fluid energy.

24. The method of claim 22, wherein determining, by the engine controller, a fuel volume value and a servo valve actuation parameter, based on the energy parameter and the measured fluid pressure value further comprises determining the fuel volume value based on the measured pressure and the energy parameter, and determining the servo valve actuation parameter based on the measured fluid pressure and a load energy parameter that is less than or equal to the energy parameter and is representative of an amount of fluid energy to be provided to the fluid load.

* * * * *